US008301056B2

(12) United States Patent
Matsushita et al.

(10) Patent No.: US 8,301,056 B2
(45) Date of Patent: Oct. 30, 2012

(54) DEVELOPING DEVICE

(75) Inventors: Yuichi Matsushita, Nagoya (JP); Fan Xu, Nagoya (JP); Mitsuru Horinoe, Aichi-ken (JP); Takashi Yasuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 514 days.

(21) Appl. No.: 12/576,685

(22) Filed: Oct. 9, 2009

(65) Prior Publication Data

US 2010/0092206 A1 Apr. 15, 2010

(30) Foreign Application Priority Data

Oct. 10, 2008 (JP) ..... 2008-264154
Oct. 10, 2008 (JP) ..... 2008-264162
Oct. 10, 2008 (JP) ..... 2008-264165
Oct. 10, 2008 (JP) ..... 2008-264169
Oct. 10, 2008 (JP) ..... 2008-264176
Oct. 10, 2008 (JP) ..... 2008-264532

(51) Int. Cl.
*G03G 15/08* (2006.01)

(52) U.S. Cl. ..... 399/103; 399/105

(58) Field of Classification Search ..... 399/103, 399/105, 274, 284
See application file for complete search history.

(56) References Cited

U.S. PATENT DOCUMENTS 6,321,050 B1 11/2001 Sato et al.
6,336,014 B1 1/2002 Sato et al.
7,239,824 B2 7/2007 Fukuta
7,336,913 B2 2/2008 Sato et al.
7,483,646 B2 * 1/2009 Ueno et al. ..... 399/102
(Continued)

FOREIGN PATENT DOCUMENTS

JP 2001-022179 1/2001
(Continued)

OTHER PUBLICATIONS

Notification of Reasons for Refusal dispatched Sep. 28, 2010 in Japanese Application No. 2008-264165 and English translation thereof.

(Continued)

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

A developing device includes a developer carrier which carries a developer, a developing unit housing which rotatably supports the developer carrier, a side seal member which comes into slidable contact with both ends of the developer carrier, a sheet-like elongated seal member which extends in the axial direction of the developer carrier so as to come into slidable contact with the developer carrier, a side seal attachment surface which is formed in the developing unit housing and to which the side seal member is attached, and a support portion which is formed in the developing unit housing and protrudes toward the developer carrier from the side seal attachment surface to support the elongated seal member. The elongated seal member is attached onto the support portion in a state where both ends thereof overlap the side seal member and are opposite the side seal attachment surface. A filler is filled in a gap surrounded by the elongated seal member, the side seal member, the support portion, and the side seal attachment surface. A protrusion for suppressing the spread of the filler is formed at the side seal attachment surface at a predetermined interval from the support portion.

3 Claims, 25 Drawing Sheets

U.S. PATENT DOCUMENTS

| | | | |
|---|---|---|---|
| 2002/0064392 | A1 | 5/2002 | Miura et al. |
| 2003/0118364 | A1 | 6/2003 | Kamimura |
| 2007/0071489 | A1 | 3/2007 | Nakaya et al. |

FOREIGN PATENT DOCUMENTS

| | | | |
|---|---|---|---|
| JP | 2002-162821 | A | 6/2002 |
| JP | 2003-195630 | A | 7/2003 |
| JP | 2003-214540 | A | 7/2003 |
| JP | 2006-039428 | | 2/2006 |
| JP | 2006-098770 | | 4/2006 |
| JP | 2007-093951 | | 4/2007 |
| JP | 3994587 | | 10/2007 |

OTHER PUBLICATIONS

Notification of Reasons for Refusal dispatched Sep. 28, 2010 in Japanese Application No. 2008-264154 and English translation thereof.

* cited by examiner

DEVELOPING DEVICE

CROSS REFERENCE TO RELATED APPLICATION

This application claims priority from Japanese Patent Application No. 2008-264154, filed on Oct. 10, 2008, Japanese Patent Application No. 2008-264162, filed on Oct. 10, 2008, Japanese Patent Application No. 2008-264165, filed on Oct. 10, 2008, Japanese Patent Application No. 2008-264169, filed on Oct. 10, 2008, Japanese Patent Application No. 2008-264176, filed on Oct. 10, 2008, and Japanese Patent Application No. 2008-264532, filed on Oct. 10, 2008, the disclosures of which are incorporated herein by reference.

TECHNICAL FIELD

The present invention relates to a developing device including a side seal member which seals between both ends of a developing roller (developer carrier) and a developing unit housing.

BACKGROUND

A related art developing device includes a rotatable developing roller which carries toner, a side seal member which comes into slidable contact with both ends of the developing roller, and a lower film (elongated seal member) which extends in the axial direction of the developing roller and comes into slidable contact with the developing roller (see Patent Document 1). Specifically, according to this technique, a support portion is formed between left and right side seal attachment surfaces, to which the side seal member is attached, to protrude from the side seal attachment surfaces, and a lower film is attached to the support portion.

The lower film is arranged such that both ends thereof overlap the side seal member and are opposite the side seal attachment surfaces. With this structure, in order to further suppress toner leakage, a filler is filled in a gap surrounded by the lower film, the side seal member, the support portion, and the side seal attachment surfaces.

Another related art developing device includes a developing roller (developer carrier) which carries toner, a developing unit housing which rotatably supports the developing roller, and a layer thickness regulating blade, the front end of which comes into slide contact with the developing roller so as to regulate the thickness of toner on the developing roller. Such a developing device has the structure in which the layer thickness regulating blade is separable from the developing unit housing so as to be easily reused (Patent Document 2).

With this structure, two seal members are provided to suppress toner leakage from both ends of the developing roller. One of the two seal members is disposed on the developing unit housing serving as a side seal member adjacent to the leading end of the layer thickness regulating blade, and the other seal member is disposed on the layer thickness regulating blade serving as a blade seal member adjacent to the side seal member. Specifically, part of the blade seal member extends onto the side seal member and is attached to the side seal member. Accordingly, toner leakage from both ends of the developing roller is suppressed, and for reuse, part of the blade seal member is peeled off from the side seal member such that the layer thickness regulating blade can be easily separated from the developing unit housing.

According to the technique described in Patent Document 1, the side seal surface having a width larger than the side seal member is formed in the developing unit housing, and the side seal member attached to the side seal attachment surface is crushed by the developing roller so as to seal between both ends of the developing roller and the developing unit housing. The side seal member is formed by laminating a surface member coming into slide contact with the developing roller and an elastically deformable base material softer than the surface member. The surface member and the base material have the same shape in plan view.

Yet another related art developing device includes a developing roller (developer carrier) which carries toner (developer), a developing unit housing which rotatably supports the developing roller, a layer thickness regulating blade which comes into slide contact with the developing roller so as to regulate the thickness of toner on the developing roller, and a blade rear seal member which is provided between the layer thickness regulating blade and the developing unit housing (Patent Document 3). Specifically, in this developing device, the blade rear seal member is formed shorter than the length of the layer thickness regulating blade in the longitudinal direction, and is disposed inward from both ends of the layer thickness regulating blade in the longitudinal direction. The layer thickness regulating blade is formed by combining a plurality of parts, and a step is formed in a portion which comes into contact with the blade rear seal member.

Yet another related art developing device includes a rotatable developing roller which carries toner, a developing unit housing which has a supply port for supplying toner to the developing roller, and a side seal member which is provided between both ends of the developing roller and the developing unit housing (a portion adjacent to the supply port) so as to come into slidable contact with the developing roller. The side seal member of such a developing device includes an upstream-side base material, a downstream-side base material which is provided on the downstream side of the upstream-side base material (on the downstream side in the rotation direction of the developing roller), and a felt member which is adhered to the upper surfaces of the upstream- and downstream-side base materials so as to come into slide contact with the developing roller (see Patent Document 4).

A developing device, such as a developing cartridge for use in an image forming apparatus, includes a boxlike case with a rectangular opening, a developing roller which is exposed from the opening to supply toner to a photosensitive drum, a layer thickness regulating blade which regulates the thickness of toner on the developing roller, and a seal member which seals a gap between the developing roller or layer thickness regulating blade and the case (for example, see Patent Document 5).

The case of such a developing cartridge has a pair of side walls and upper and lower opening edges forming the opening, and is divided into a boxlike lower frame with an opening on the upper side and a plate-shaped upper frame which is combined so as to cover the opening on the upper side of the lower frame. With this structure, the upper opening edge (beam-like portion) is formed in the lower frame, so the extraction from the mold during manufacturing should be conducted forward from the opening on the front side of the lower frame and upward from the opening on the upper side of the lower frame.

[Patent Document 1] JP-A-2001-27846
[Patent Document 2] JP-A-2007-93951
[Patent Document 3] JP-A-2006-39428
[Patent Document 4] JP-A-2001-22179
[Patent Document 5] JP-A-2006-98770

SUMMARY

According to the related art described in Patent Document 1, the side seal attachment surface is comparatively wide, so the filler filled in the gap may spread on the side seal attachment surface, and the filler may be wastefully consumed.

Accordingly, an object of the invention provides a developing device capable of reducing filler consumption.

According to the related art described in Patent Document 2, the blade seal member overlaps the side seal member to form a step, so the blade seal member may be peeled off from the end by the rotating developing roller, and toner may leak.

Accordingly, another object of the invention provides a developing device capable of suppressing toner (developer) leakage in a structure where a side seal member and a blade seal member are provided.

According to the related art described in Patent Document 1, in order to accurately position the side seal member on the wide side seal attachment surface, a positioning rib may be provided. In this case, if the side seal member is provided so as to be adjacent to the rib, even if the base material of the side seal member is crushed by the developing roller and tends to expand in the horizontal direction, the deformation is limited by the rib. For this reason, the base material is deformed so as to escape from between the hard surface member and the rib. However, since the side surface of the surface member and the side surface of the base material are flush with each other, the space between the surface member and the rib is narrow, the deformation of the base material is suppressed, and a portion where deformation is suppressed is extremely compressed. If a portion of the base material is extremely compressed, contact pressure between the developing roller and the surface member in the compressed portion may increase, and the developing roller may be damaged.

Accordingly, yet another object of the invention provides a seal member capable of preventing a developing roller (developer carrier) from being damaged, and a developing device having the seal member.

According to the related art described in Patent Document 3, if the blade rear seal member is formed by two sheets, when the blade rear seal member is interposed between the layer thickness regulating blade and the developing unit housing, the blade rear seal member is satisfactorily slipped into the corner of the step portion of the layer thickness regulating blade. However, when the blade rear seal member is formed by a single sheet, the blade rear seal member may not be satisfactorily slipped into the corner of the step portion of the enter layer thickness regulating blade, a gap may be formed, and toner may leak from the gap.

Accordingly, yet another object of the invention provides a developing device capable of suppressing toner leakage even though a gap is formed between a blade rear seal member and a layer thickness regulating blade.

According to the technique described in Patent Document 4, when toner enters the surface of the felt member, the direction of fabric of the felt member is not uniform. For this reason, toner may be moved in a direction away from the supply port due to slide contact with the developing roller, and toner leakage may be generated.

Accordingly, yet another object of the invention provides a developing device capable of suppressing toner (developer) leakage.

With respect to the technique described in Patent Document 5, a configuration is suggested in which a beam-like portion is provided in the upper frame, such that the forward extraction from the mold does not need to be conducted during manufacturing of the lower frame.

With the configuration in which the beam-like portion is provided in the upper frame, in order to suppress toner leakage from the gap between the beam-like portion of the upper frame and the side wall of the lower frame, a seal member (frame seal) is provided between the beam-like portion of the upper frame and the side wall of the lower frame. The frame seal is configured such that one end thereof is opposite a seal member (blade rear seal member) which blocks the gap between the layer thickness regulating blade and the case.

The seal member includes an elastic layer formed of sponge or the like, and an adhesive base material for attachment to the case or the like. In this case, if one end of the frame seal bites into the blade rear seal member so as to block the gap between the seal members, the adhesive base material solider than the frame seal may press the blade rear seal member, the blade rear seal member may be recessed, and a gap may be formed.

Toner leakage may be suppressed by filling grease or the like in the gap, but a step of filling grease or the like is necessary, which makes the manufacturing method complicated. Accordingly, yet another object of the invention provides a developing device capable of suppressing the occurrence of a gap between the frame seal and the blade rear seal member so as to suppress developer leakage.

According to one of the above described aspects of the invention, a developing device includes a developer carrier which carries a developer, a developing unit housing which rotatably supports the developer carrier, a side seal member which comes into slidable contact with both ends of the developer carrier, a sheet-like elongated seal member which extends in the axial direction of the developer carrier so as to come into slidable contact with the developer carrier, a side seal attachment surface which is formed in the developing unit housing and to which the side seal member is attached, and a support portion which is formed in the developing unit housing and protrudes toward the developer carrier from the side seal attachment surface to support the elongated seal member. The elongated seal member is attached onto the support portion in a state where both ends thereof overlap the side seal member and are opposite the side seal attachment surface. A filler is filled in a gap surrounded by the elongated seal member, the side seal member, the support portion, and the side seal attachment surface. A protrusion for suppressing the spread of the filler is formed at the side seal attachment surface at a predetermined interval from the support portion.

With this configuration, if the filler is filled in the gap surrounded by the elongated seal member, the side seal member, the support portion, and the side seal attachment surface, the filler which flows so as to spread on the side seal attachment surface is stopped by the protrusion. Therefore, there is no case where the filler wastefully spreads on the side seal attachment surface, and thus filler consumption can be reduced.

According to another aspect of the invention, a developing device includes a developer carrier which carries a developer, a developing unit housing which rotatably supports the developer carrier, a layer thickness regulating blade which is provided in the developing unit housing and the front end of which comes into slide contact with the developer carrier regulates the thickness of the developer on the developer carrier, a side seal member which is adjacent to the leading end of the layer thickness regulating blade and comes into slidable contact with both ends of the developer carrier, and a blade seal member which is provided at both ends of the layer thickness regulating blade so as to come into slidable contact with both ends of the developer carrier at a position adjacent to the side seal member. The blade seal member is provided so as to be bent from the leading end of the layer thickness regulating blade and to curve from the front surface to the rear surface.

With this configuration, the blade seal member is provided so as to be bent from the leading end of the layer thickness regulating blade and to curve from the front surface to the rear surface. Therefore, even though the developing roller comes into slide contact with the boundary between the side seal member and the blade seal member, there is no case where the blade seal member is peeled off by the developing roller.

According to yet another aspect of the invention, a seal member is formed by laminating a surface member and an elastically deformable base material softer than the surface member. The side surface of the surface member is disposed inward from the side surface of the base material.

According to yet another aspect of the invention, a developing device includes a developer carrier which carries a developer, a developing unit housing which rotatably supports the developer carrier, a seal member which is formed by laminating a surface member which comes into slide contact with the developer carrier and an elastically deformable base material softer than the surface member, and a wall which is adjacent to the side surface of the base material of the seal member. The side surface of the surface member is disposed inward from the side surface of the base material so as to be away from the wall.

With this configuration, the side surface of the surface member is disposed inward from the side surface of the base material. For this reason, even though the seal member is crushed in a state where the side surface of the base material of the seal member is in contact with the wall, the gap of the surface member and the wall is wide, so the soft base material can escape from the wide gap. Therefore, the base material is prevented from being extremely compressed, so when the seal member is used in the seal structure around the developer carrier of the developing device, the developer carrier can be prevented from being damaged.

According to yet another aspect of the invention, a developing device includes developer carrier which carries a developer, a developing unit housing which rotatably supports the developer carrier, a layer thickness regulating blade which comes into slide contact with the developer carrier so as to regulate the thickness of the developer on the developer carrier, and a blade rear seal member which is provided between the layer thickness regulating blade and the developing unit housing. The blade rear seal member is formed longer than the length in the longitudinal direction of the layer thickness regulating blade so as to protrude from both ends of the layer thickness regulating blade in the longitudinal direction.

With this configuration, the blade rear seal member is formed longer than the length in the longitudinal direction of the layer thickness regulating blade so as to protrude from both ends of the layer thickness regulating blade. For this reason, if the layer thickness regulating blade is pressed against the blade rear seal member, both edges of the layer thickness regulating blade are covered with both ends of the blade rear seal member. Therefore, even though a gap is formed between the blade rear seal member and the layer thickness regulating blade, the gap is blocked by both ends of the blade rear seal member, so developer leakage can be suppressed.

According to yet another aspect of the invention, a developing device includes a developer carrier which carries a developer, a developing unit housing which rotatably supports the developer carrier and has a supply port for supplying the developer to the developer carrier, a layer thickness regulating blade which is provided in the developing unit housing and comes into slide contact with the developer carrier so as to regulate the thickness of the developer on the developer carrier, a side seal member which is provided between both ends of the developer carrier and a portion adjacent to the supply port of the developing unit housing, and comes into slidable contact with the developer carrier, and a sheet-like elongated seal member which extends in the axial direction of the developer carrier so as to come into slide contact with the developer carrier and both ends of which overlap the side seal member. The side seal member is configured so as to deliver the developer in an oblique direction toward the supply port with a decreasing distance to the downstream side in the rotation direction of the developer carrier, and both edges of the elongated seal member are formed in an oblique direction toward the supply port with a decreasing distance to the downstream side in the rotation direction of the developer carrier.

With this configuration, when the developer enters the surface of the side seal member, the developer on the side seal member moves in the oblique direction toward the supply port as a decreasing distance to the downstream side in the rotation direction and returns to the supply port by the rotation of the developer carrier. For this reason, developer leakage is suppressed. Further, both edges of the elongated seal member overlapping the side seal member are formed in the oblique direction toward the supply port with a decreasing distance to the downstream side in the rotation direction of the developer carrier. For this reason, the developer which is obliquely delivered by the side seal member is unlikely to remain at both edges of the elongated seal member and moves along both edges. Therefore, developer can be prevented from leaking or the developer carrier can be prevented from being damaged due to the developer remaining at both edges of the elongated seal member.

According to yet another aspect of the invention, a developing device includes a first frame which has a pair of side walls arranged to be opposite each other and a connection wall connecting the side walls, a second frame which has a beam-like portion forming an opening together with the side walls and the connection wall when being combined with the first frame, a frame seal which is disposed between each side wall and the beam-like portion so as to block a gap between each side wall and the beam-like portion, a developer carrier which is exposed to the outside through the opening and carries a developer, a layer thickness regulating blade which is disposed over each side wall and the beam-like portion so as to regulate the thickness of the developer on the developer carrier, and a blade rear seal member which is disposed between the layer thickness regulating blade and the beam-like portion so as to block a gap between the layer thickness regulating blade and the beam-like portion. The frame seal has an elastic layer and an adhesive base material. An end of the frame seal on the blade rear seal member side is bent such that the elastic layer comes into close contact with the blade rear seal member, and the adhesive base material is provided on the side of the bent portion in contact with the first frame or the second frame.

With the developing device configured as above, the end of the frame seal is bent such that the elastic layer comes into close contact with the blade rear seal member, so the occurrence of a gap can be suppressed. Further, the adhesive base material is provided on the side of the bent portion in contact with the frame (an opposite side to the blade rear seal member with the elastic layer interposed therebetween), so the elastic layer and the blade rear seal member can reliably come into close contact with each other, and the occurrence of a gap can be suppressed.

According to yet another aspect of the invention, a developing device includes a first frame which has a pair of side walls arranged to be opposite each other and a connection wall connecting the side walls, a second frame which has a beam-like portion forming an opening together with the side walls and the connection wall when being combined with the first frame, a frame seal which is disposed between each side wall and the beam-like portion so as to block a gap between each side wall and the beam-like portion, a developer carrier which is exposed to the outside through the opening and carries a developer, a layer thickness regulating blade which is disposed over each side wall and the beam-like portion so as to regulate the thickness of the developer on the developer carrier, and a blade rear seal member which is disposed between the layer thickness regulating blade and the beam-like portion so as to block a gap between the layer thickness regulating blade and the beam-like portion. The frame seal has an elastic layer and an adhesive base material, and the elastic layer protrudes toward the blade rear seal member from the adhesive base material, such that only the elastic layer bites into the blade rear seal member.

With the developing device configured as above, the elastic layer protrudes toward the blade rear seal member from the adhesive base material, such that only the elastic layer bites into the blade rear seal member, so the elastic layer and the blade rear seal member can come into close contact with each other, and the occurrence of a gap can be suppressed. Further, the adhesive base material does not bite into the blade rear seal member, so the occurrence of a gap due to the adhesive base material pressing against the blade rear seal member can be suppressed.

According to the one of the aspects of the invention, the protrusion for suppressing the spread of the filler is provided at the side seal attachment surface. Therefore, the filler can be prevented from wastefully spreading on the side seal attachment surface, and thus filler consumption can be reduced.

According to another aspect of the invention, the blade seal member is provided so as to be bent from the leading end of the layer thickness regulating blade and to curve from the front surface to the rear surface. Therefore, there is no case where the blade seal member is peeled off by the rotating developing roller, and thus developer leakage can be suppressed.

According to yet another aspect of the invention, the side surface of the surface member is disposed inward from the side surface of the base material, so it is possible to prevent the soft base material from escaping from a wide gap between the surface member and the wall, and from being extremely compressed. Therefore, when the seal member is used in the developing device, the developer carrier can be prevented from being damaged.

According to yet another aspect of the invention, the blade rear seal member protrudes from both ends of the layer thickness regulating blade. Therefore, even though a gap is formed between the blade rear seal member and the layer thickness regulating blade, the gap can be blocked by both ends of the blade rear seal member, and thus developer leakage can be suppressed.

According to yet another aspect of the invention, even though the developer enters the surface of the side seal member, the developer can return to the supply port by the side seal member which obliquely delivers the developer, so developer leakage can be suppressed. Further, the developer is unlikely to remain at both edges of the elongated seal member, so developer can be prevented from leaking or the developer carrier can be prevented from being damaged due to the developer remaining at both edges of the elongated seal member.

With the above-described developing device, the occurrence of a gap between the frame seal and the blade rear seal member can be suppressed, and thus developer leakage can be suppressed.

BRIEF DESCRIPTION OF THE DRAWINGS

FIG. 5A is a sectional view taken along the line X-X of FIG. 4, and FIG. 5B is a sectional view taken along the line Y-Y of FIG. 4;

FIG. 11A is an enlarged perspective view showing the structure around a side seal member, FIG. 11B is a sectional view showing details of a side seal member, FIG. 11C is an enlarged perspective view of an X portion in FIG. 11A, and FIG. 11D is an enlarged perspective view of a Y portion in FIG. 11A;

DETAILED DESCRIPTION OF EXEMPLARY EMBODIMENTS OF THE PRESENT INVENTION

Figure 1:
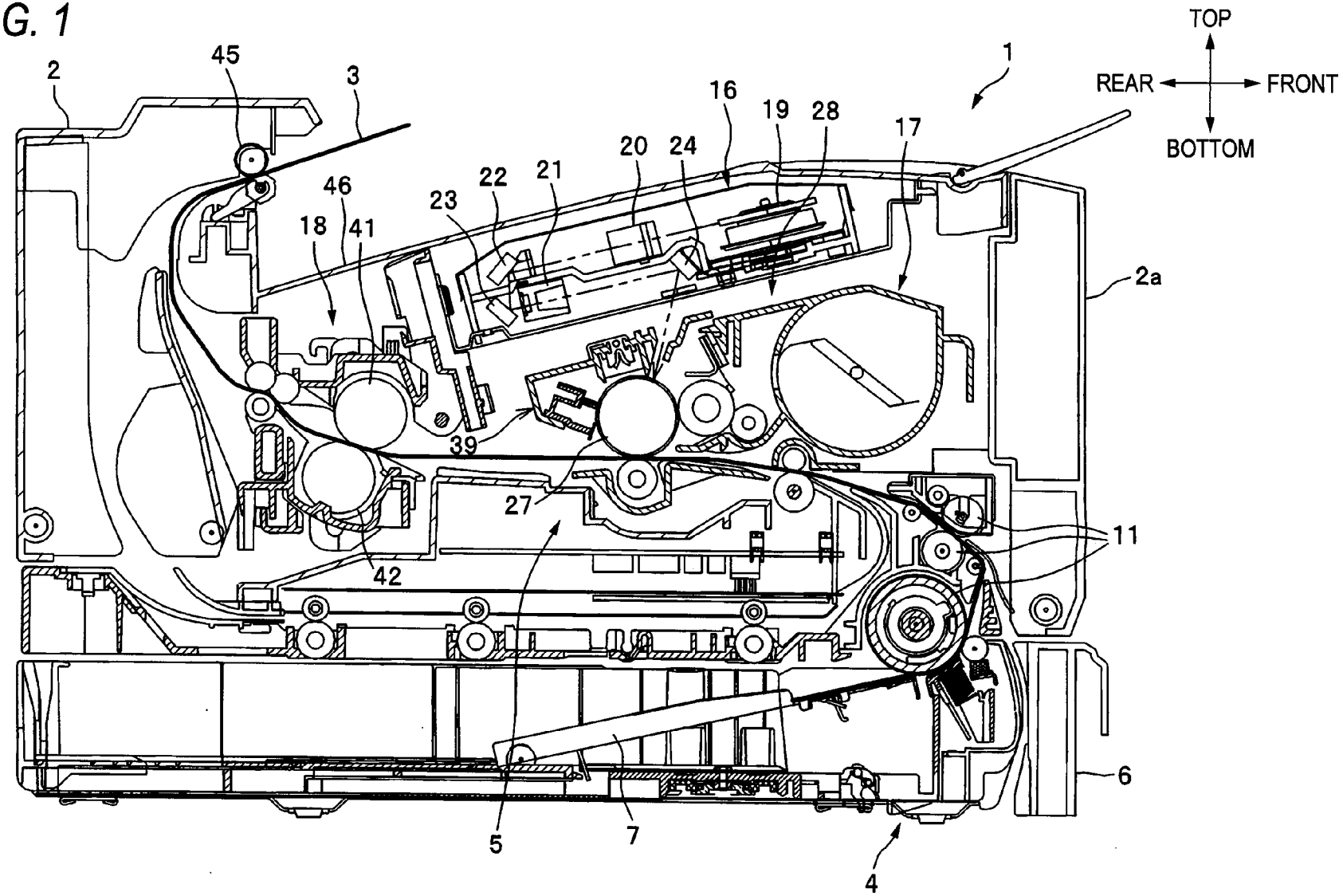
FIG. 1 is a side sectional view showing a laser printer having a developing cartridge according to a first embodiment of the invention.
Figure 2:
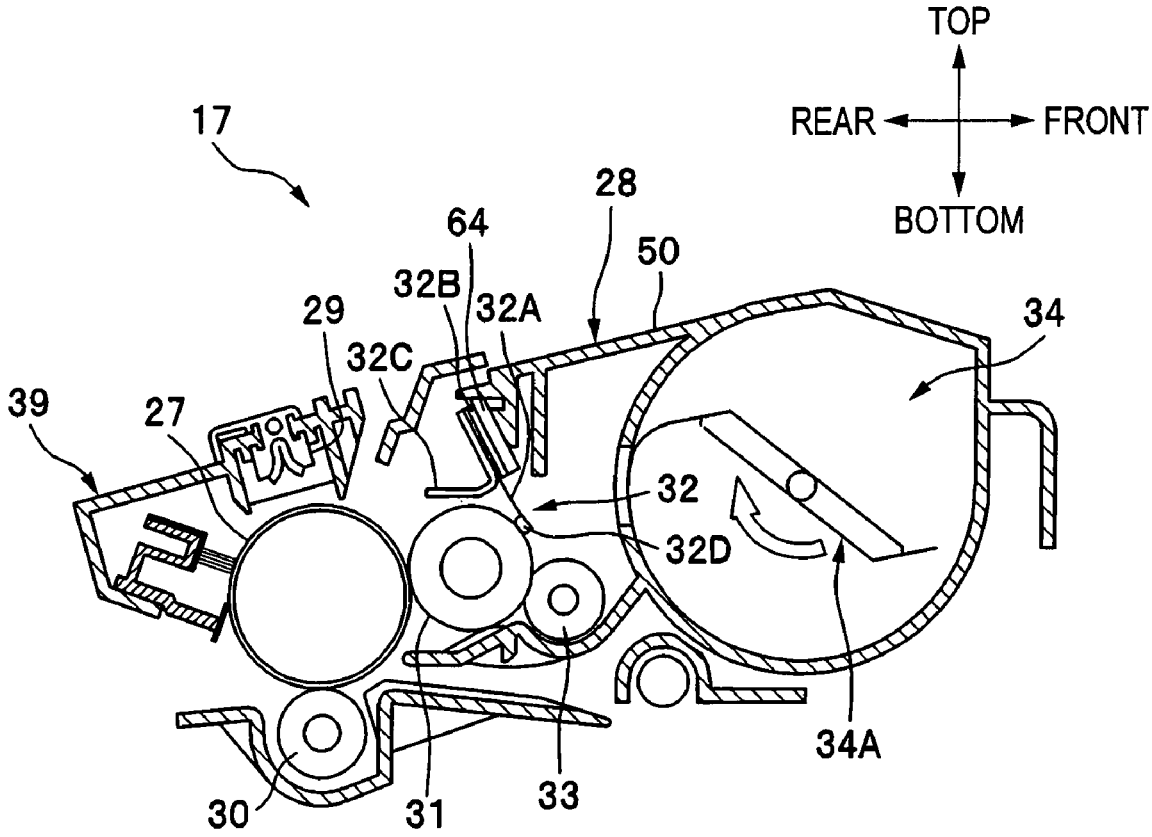
FIG. 2 is a side sectional view showing a developing cartridge.

A first embodiment of the invention will now be described in detail with reference to the drawings. FIG. 1 is a side sectional view showing a laser printer having a developing cartridge according to an embodiment of the invention. FIG. 2 is a side sectional view showing a developing cartridge. In the following description, after brief description of the overall configuration of the laser printer, details of the configuration will be described.

In the following description, directions are defined as viewed from a user when using a laser printer 1. That is, in FIG. 1, the right side is referred to as the "front side", the left side is referred to as the "rear side", the rear side in the direction perpendicular to the paper is referred to as the "right side", and the front side in the direction perpendicular to the paper is referred to as the "left side". The up-down direction is referred to as the "up-down direction" since the direction in the drawing matches the direction of the user when using the laser printer.

<Overall Configuration of Laser Printer>

As shown in FIG. 1, the laser printer 1 includes, in a main body casing 2, a feeder unit 4 for feeding a sheet 3, an image forming unit 5 for forming an image on the sheet 3, and the like.

<Configuration of Feeder Unit>

The feeder unit 4 includes a sheet feed tray 6 which is detachably mounted at the bottom of the main body casing 2, and a sheet pressing plate 7 which is provided in the sheet feed tray 6. The feeder unit 4 also includes various rollers 11 for transporting the sheet 3 or removing paper dust. In the feeder unit 4, the sheet 3 in the sheet feed tray 6 is tilted upward by the sheet pressing plate 7 and transported to the image forming unit 5 by various rollers 11.

<Configuration of Image Forming Unit>

The image forming unit 5 includes a scanner unit 16, a process cartridge 17, a fixing unit 18, and the like.

<Configuration of Scanner Unit>

The scanner unit 16 is provided at the upper portion of the main body casing 2, and includes a laser light emitting unit (not shown), a polygon mirror 19 being driven to rotate, lenses 20 and 21, reflecting mirrors 22, 23, and 24, and the like. In the scanner unit 16, a laser beam is irradiated onto the surface of a photosensitive drum 27 through a path indicated by a chain line in the drawing by high-speed scanning.

<Configuration of Process Cartridge>

The process cartridge 17 is detachably mounted in the main body casing 2 after appropriately opening a front cover 2*a* provided on the front side of the main body casing 2. The process cartridge 17 mainly includes a developing cartridge 28 as an example of a developing device and a drum unit 39.

The developing cartridge 28 is detachably mounted in the main body casing 2 while being mounted on the drum unit 39. The developing cartridge 28 may be detachably mounted on the drum unit 39 fixed to the main body casing 2. As shown in FIG. 2, the developing cartridge 28 mainly includes a developing roller 31 as an example of a developer carrier, a layer thickness regulating blade 32, a supply roller 33, and a toner containing chamber 34.

In this developing cartridge 28, toner as an example of a developer in the toner containing chamber 34 is stirred by an agitator 34A and then supplied to the developing roller 31 by the supply roller 33. At this time, toner is positively frictionally charged between the supply roller 33 and the developing roller 31. Toner supplied onto the developing roller 31 enters between the layer thickness regulating blade 32 and the developing roller 31 by the rotation of the developing roller 31 and is then carried on the developing roller 31 in the form of a thin film with a uniform thickness. The details of the developing cartridge 28 will be described below.

The drum unit 39 mainly includes a photosensitive drum 27, a Scorotron-type charger 29, and a transfer roller 30. In the drum unit 39, the surface of the photosensitive drum 27 is positively charged uniformly by the Scorotron-type charger 29 and then exposed by high-speed scanning of laser beams from the scanner unit 16. In this way, the potential of the exposed portion falls down, and an electrostatic latent image based on image data is formed.

Next, toner carried on the developing roller 31 is supplied to the electrostatic latent image formed on the surface of the photosensitive drum 27 by the rotation of the developing roller 31, and a toner image is formed on the surface of the photosensitive drum 27. Thereafter, the sheet 3 is transported between the photosensitive drum 27 and the transfer roller 30, and the toner carried on the surface of the photosensitive drum 27 is transferred to the sheet 3.

<Configuration of Fixing Unit>

As shown in FIG. 1, the fixing unit 18 includes a heating roller 41, and a pressing roller 42 which is disposed to be opposite the heating roller 41 so as to press the heating roller 41. In the fixing unit 18 configured as above, toner transferred onto the sheet 3 is thermally fixed while the sheet 3 passes through between the heating roller 41 and the pressing roller 42. The sheet 3 thermally fixed by the fixing unit 18 is transported to a sheet discharge roller 45 provided on the downstream side of the fixing unit 18 and then delivered from the sheet discharge roller 45 onto a sheet discharge tray 46.

<Detailed Structure of Developing Cartridge>

Figure 3:
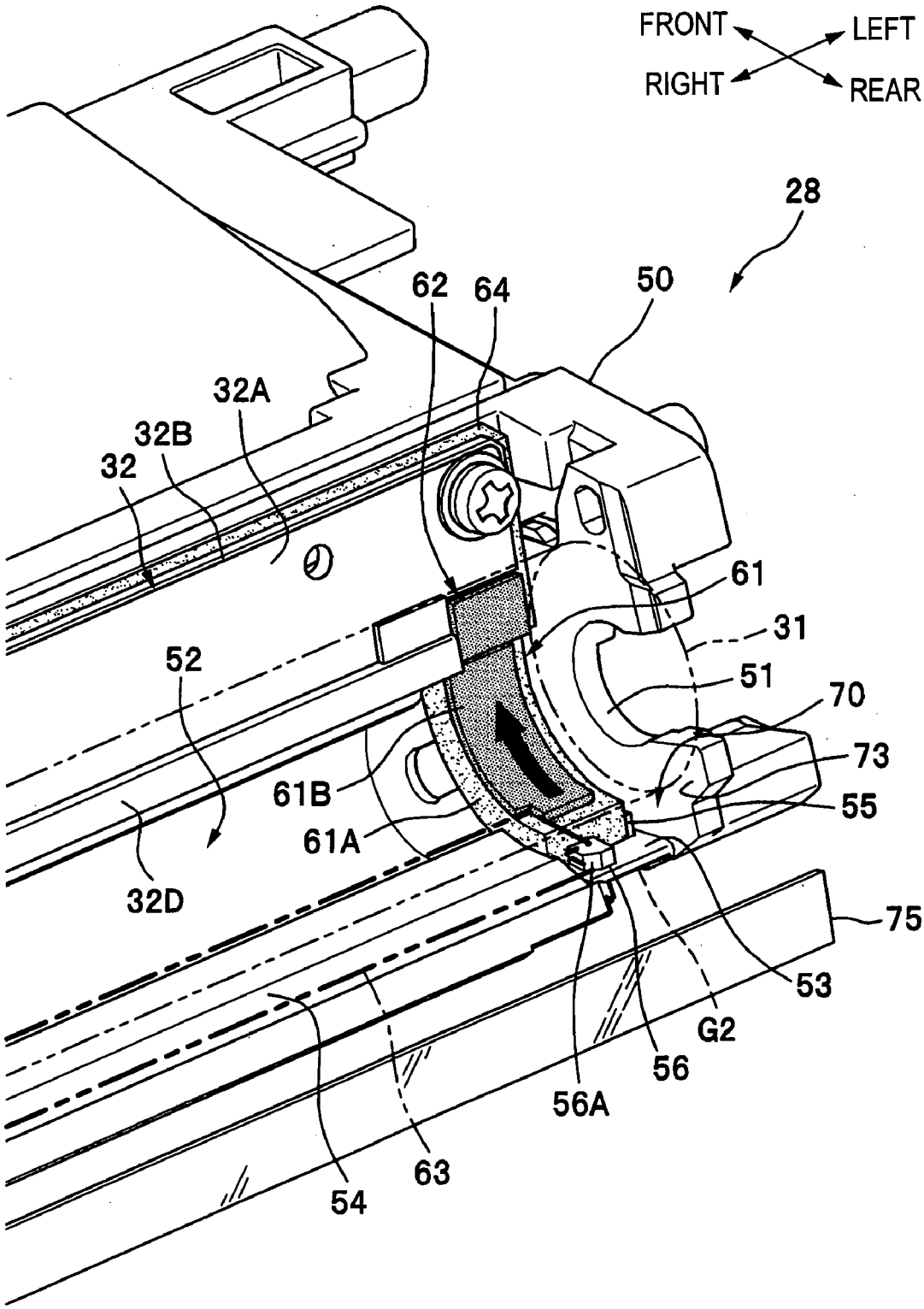
FIG. 3 is an enlarged perspective view showing the structure around a supply port.
Figure 4:
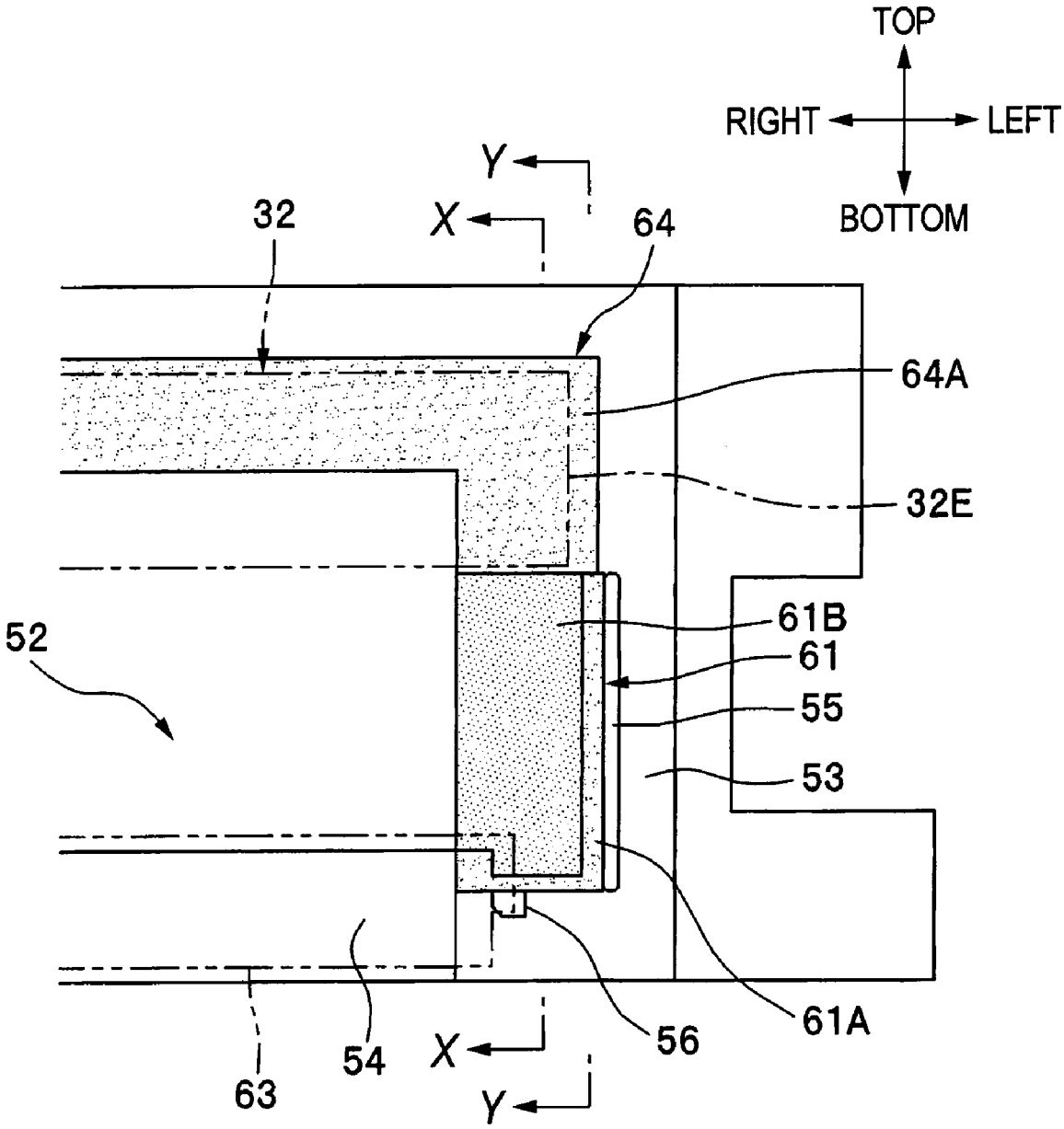
FIG. 4 is a front view schematically showing the structure around a supply port.
Figure 5A:
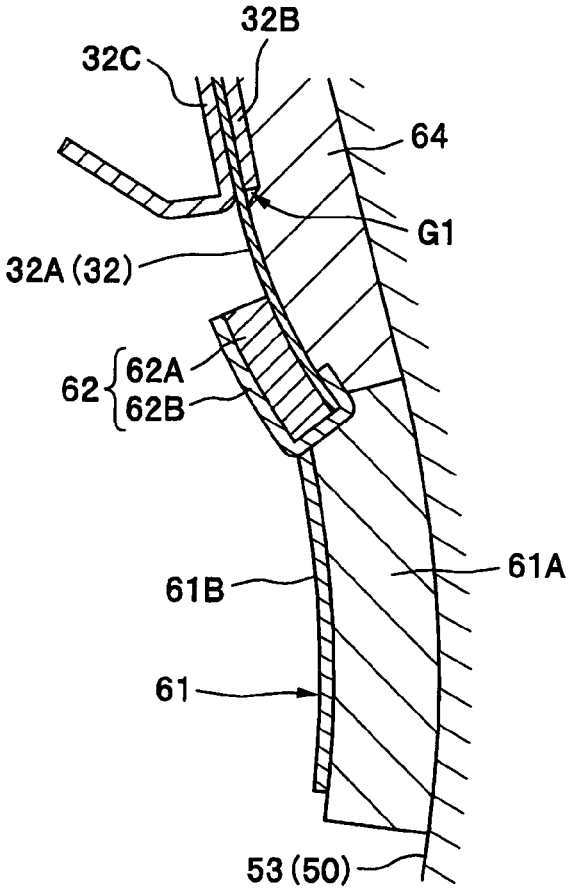
FIGS. 5A and 5B show the structure around a supply port.
Figure 5B:
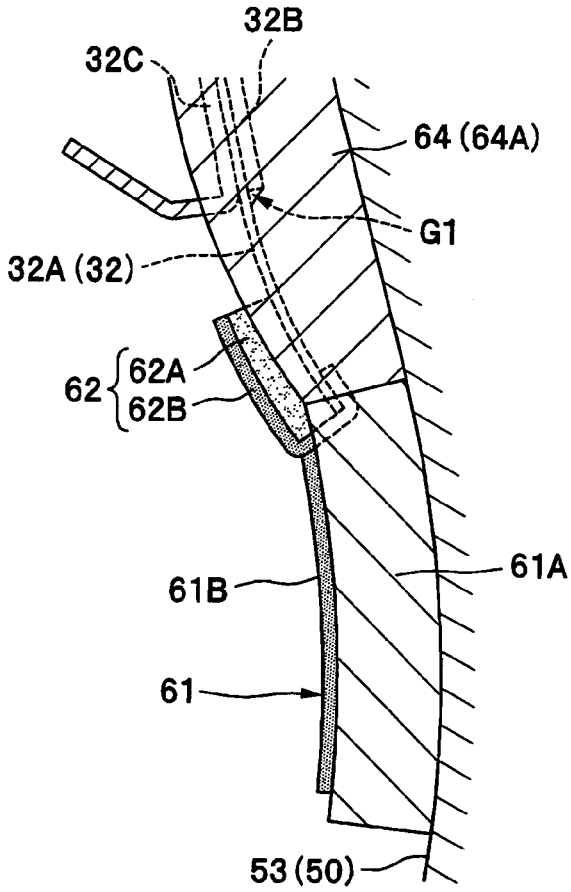
Figure 7A:
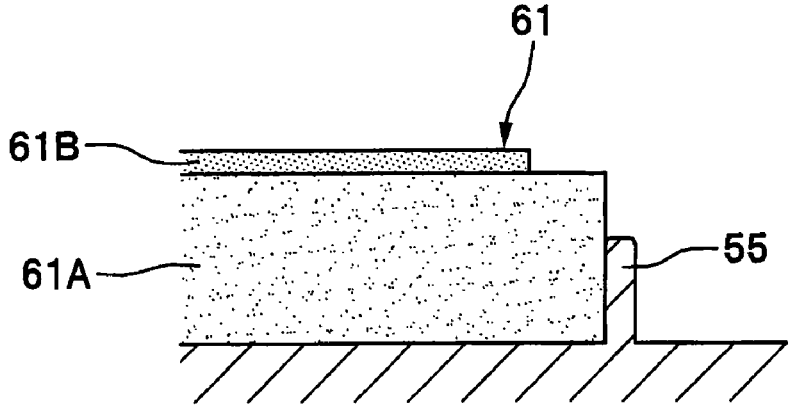
FIGS. 7A to 7C are diagrams showing the operation of a side seal member in which the side surface of a surface member is disposed inward from the side surface of a base material.
Figure 7B:
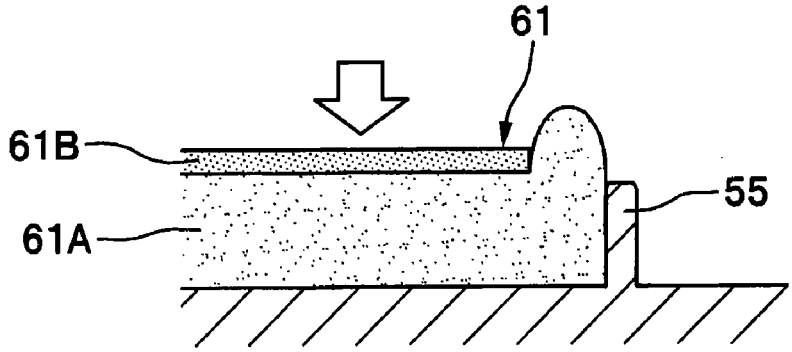
Figure 7C:
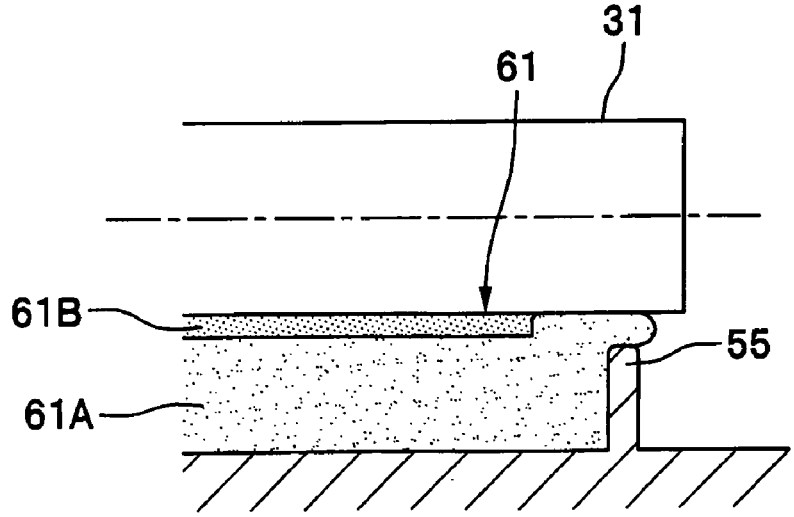
Figure 8A:
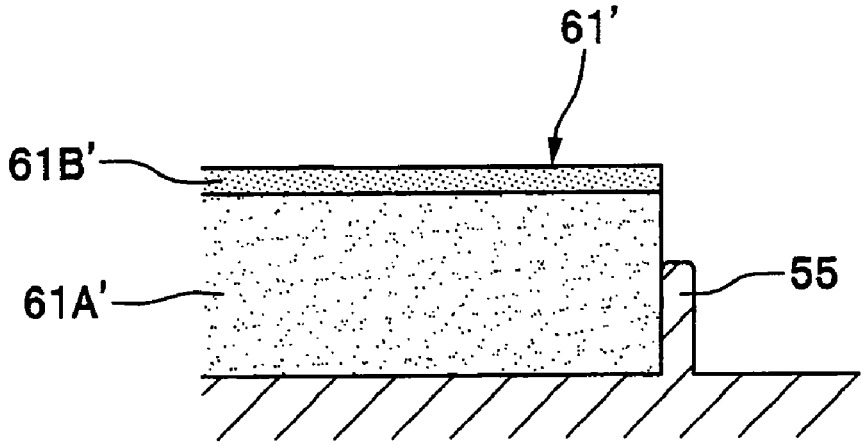
FIGS. 8A and 8B are diagrams showing the operation of a side seal member in which the side surfaces of a surface member and a base material are flush with each other.
Figure 8B:
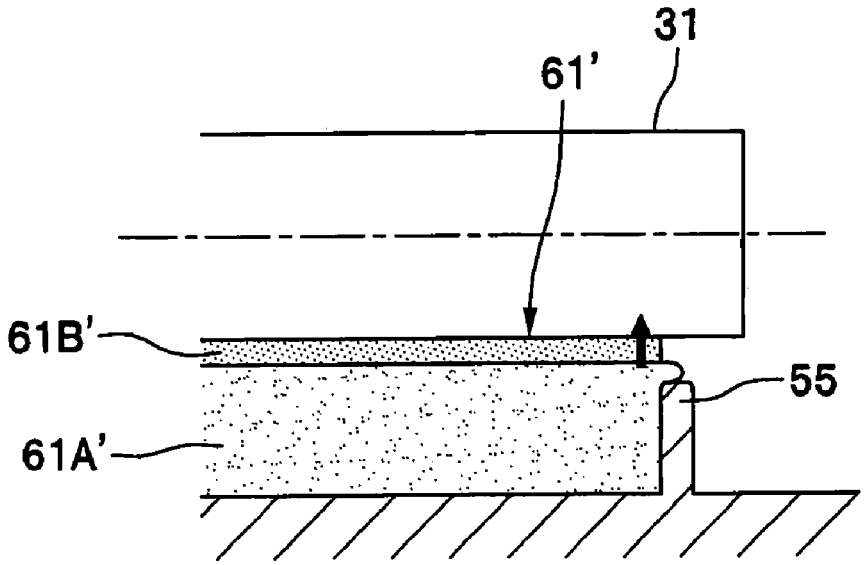

Next, the detailed structure of the developing cartridge 28 according to an embodiment of the invention will be described. FIG. 3 is an enlarged perspective view showing the structure around a supply port. FIG. 4 is a front view schematically showing the structure around a supply port. FIG. 5A is a sectional view taken along the line X-X of FIG. 4, and FIG. 5B is a sectional view taken along the line Y-Y of FIG. 4. FIGS. 6A to 6D are diagrams showing an operation to fill a filler in a gap surrounded by a lower film, a side seal member, a support portion, and a side seal attachment surface. FIGS. 7A to 7C are diagrams showing the operation of a side seal member in which the side surface of a surface member is disposed inward from the side surface of a base material. FIG. 8A and FIG. 8B are diagrams showing the operation of a side seal member in which the side surfaces of a surface member and a base material are flush with each other.

The developing cartridge 28 has a symmetric structure in the left-right direction. Therefore, in FIG. 3 and the like, only one of the left and right sides is shown, and the other side is not shown. FIG. 3 and the like show a state where the developing roller 31 or the supply roller 33 is removed.

As shown in FIG. 3, the developing cartridge 28 includes, in addition to the above-described developing roller 31 and the like, a developing unit housing 50 which rotatably supports the developing roller 31, a side seal member 61 and a blade seal member 62 which come into slide contact with both ends of the developing roller 31, and a lower film 63 as an example of an elongated seal member. The developing roller 31 rotates in a direction indicated by an arrow in the drawing, that is, so as to come into slide contact with the lower film 63, the side seal member 61, and the blade seal member 62 in that order.

The developing unit housing 50 mainly has a bearing portion 51 which rotatably supports the developing roller 31, a supply port 52 for supplying toner from the internal toner containing chamber 34 to the developing roller 31, side seal attachment surfaces 53 to which the side seal member 61 is attached, and a support portion 54 which supports the lower film 63. The supply port 52 is formed in a rectangular long hole shape in the axial direction of the developing roller 31, and the layer thickness regulating blade 32 is fixed above the supply port 52.

As shown in FIG. 2, the layer thickness regulating blade 32 includes a metal plate 32A, reinforcing plate 32B and 32C which sandwich the upper portion of the metal plate 32A therebetween so as to reinforce the metal plate 32A, and a rubber pressing member 32D which is fixed to the lower end (front end) of the metal plate 32A and has a width smaller than that of the metal plate 32A in the left-right direction. The layer thickness regulating blade 32 is configured such that the upper portion of the metal plate 32A sandwiched between the reinforcing plates 32B and 32C is fixed to the developing unit housing 50, and the pressing member 32D at the front end thereof comes into slide contact with the developing roller 31 while being pressed by a pressing force from the metal plate 32A. FIG. 3 shows a state where the outer reinforcing plate 32C is removed from the metal plate 32A.

A U-shaped blade rear seal member 64 is provided between the layer thickness regulating blade 32 and the developing unit housing 50. Specifically, as schematically shown in FIG. 4, the blade rear seal member 64 is formed in a U shape so as to surround the upper portion of the supply port 52, and both ends thereof are attached to the upper portion of each side seal attachment surface 53.

The blade rear seal member 64 is formed longer than the length of the layer thickness regulating blade 32 in the left-right direction (longitudinal direction), and is provided such that both ends 64A thereof protrude from both ends 32E of the layer thickness regulating blade 32. Accordingly, when the blade rear seal member 64 is crushed so as to fix the layer thickness regulating blade 32 to the developing unit housing 50, as shown in FIG. 5B, the left and right edges of the layer thickness regulating blade 32 are covered with both ends 64A of the blade rear seal member 64 which is not crushed. For this reason, a minute gap G1 formed between the crushed blade rear seal member 64 and the step portion of the layer thickness regulating blade 32 (a step formed by the metal plate 32A and the inner reinforcing plate 32B) is blocked by both ends 64A of the blade rear seal member 64, so toner leakage is suppressed.

As shown in FIG. 3, the side seal attachment surfaces 53 have a substantially arc shape in side view, and formed on the left and right sides of the supply port 52. At the side seal attachment surfaces 53 are formed positioning walls 55 which come into contact with (is adjacent to) the outer side surfaces of the side seal member 61 in the left-right direction so as to position the side seal member 61 in the left-right direction, and protrusions 56 which come into contact with the side surfaces on the rear side of the side seal member 61 so as to position the seal member 61 in the front-rear direction.

The positioning walls 55 are long walls which extend in the rotation direction of the developing roller 31 (see FIG. 4), and are formed such that the height thereof is lower than the side seal member 61.

Figure 6A:
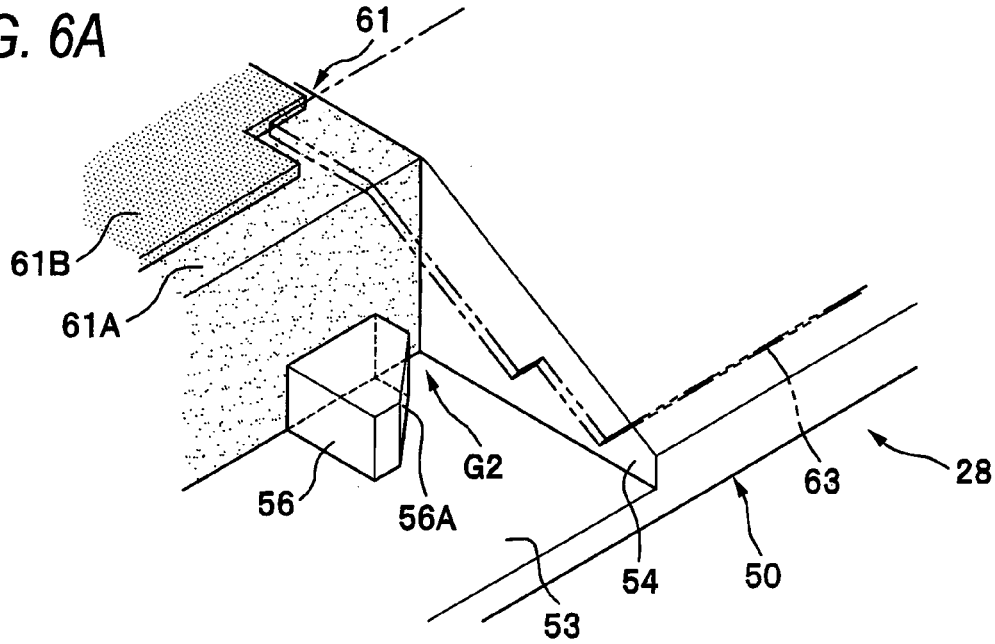
FIGS. 6A to 6D are diagrams showing an operation to fill a filler in a gap surrounded by a lower film, a side seal member, a support portion, and a side seal attachment surface.

As shown in FIG. 6A, each protrusion 56 is formed so as to be spaced at a predetermined interval (comparatively narrow interval) from the support portion 54. With this structure, a filler F (see FIG. 6D) which is filled in a gap G2 surrounded by the lower film 63, the side seal member 61, the support portion 54, and the side seal attachment surface 53 is prevented from spreading outward in the left-right direction. The predetermined interval may be set to be equal to or smaller than half of the width of the side seal member 61 in the left-right direction.

Figure 6B:
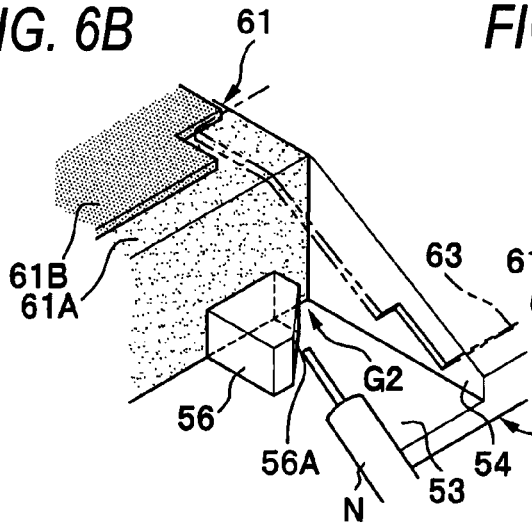
Figure 6C:
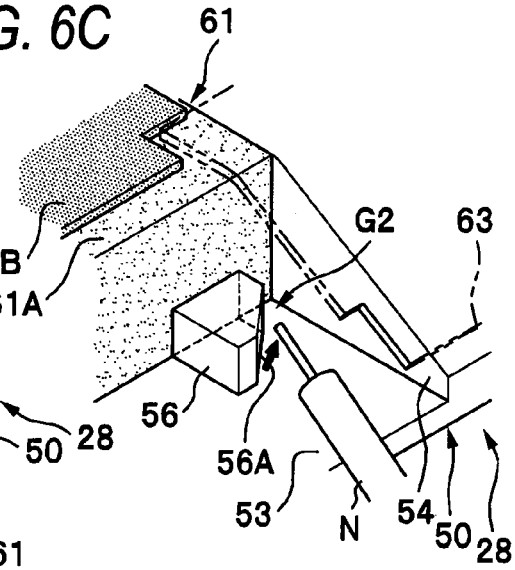
Figure 6D:
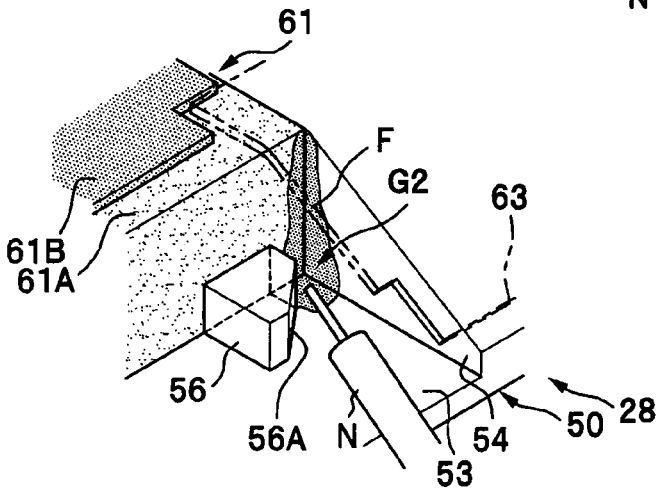

A portion (rear portion) of the opposing surface of the protrusion 56 with respect to the support portion 54 has an inclined surface 56A which is inclined so as to be close to the support portion 54 with a decreasing distance to the side seal member 61. Therefore, as shown in FIGS. 6B to 6D, a nozzle N for injecting the filler F is guided to the gap G2 by the inclined surface 56A.

The support portion 54 is formed so as to protrude toward the developing roller 31 from the side seal attachment surface 53 and to extend in the axial direction of the developing roller 31.

As shown in FIG. 3, the side seal member 61 is provided between both ends of the developing roller 31 and the side seal attachment surfaces 53 adjacent to the left and right sides of the supply port 52 in the developing unit housing 50. Specifically, the side seal member 61 is provided so as to be adjacent to the front end (lower end) of the layer thickness regulating blade 32 in the rotation direction of the developing roller 31.

The side seal member 61 includes an elastic base material 61A, and a surface member 61B which is laminated on the surface of the base material 61A facing the developing roller 31. The base material 61A is formed of an elastic material, such as elastically deformable urethane sponge, which is softer than the surface member 61B. The base material 61A is attached to the side seal attachment surface 53 of the developing unit housing 50 by a double-sided tape or an adhesive. Specifically, the base material 61A is provided such that the side surface thereof comes into contact with the positioning wall 55, the protrusion 56, and the support portion 54. The term "side surface" means a surface perpendicular to the boundary surface between the surface member 61B and the base material 61A.

The surface member 61B is formed of a material, such as felt or the like, to be thinner than the base material 61A, and is attached to the base material 61A by a double-sided tape or the like. The surface member 61B is disposed inward from the side surface of the base material 61A such that the side surface thereof is away from the positioning wall 55, the protrusion 56, and the support portion 54.

With this structure, as shown in FIGS. 7A and 7B, if the side seal member 61 is crushed from above, the deformation of the base material 61A in the horizontal direction (front-rear direction) is suppressed by the adjacent positioning wall 55, and the base material 61A protrudes upward from between the surface member 61B and the positioning wall 55. For this reason, as shown in FIG. 7C, when the developing roller 31 is pressed against the entire side seal member 61, the base material 61A protruding from between the surface member 61B and the positioning wall 55 escapes to the gap between the positioning wall 55 and the developing roller 31 and is sandwiched between the developing roller 31 and the positioning wall 55 without being nearly compressed. Therefore, a load applied from the base material 61A to the developing roller 31 is reduced.

In contrast, as shown in FIG. 8A, when the side surface of a surface member 61W is flush with the side surface of a base material 61A', if developing roller 31 is pressed against the entire side seal member 61', as show in FIG. 8B, the base material 61A' may not escape from the narrow gap between the surface member 61B' and the positioning wall 55, and may be compressed between the hard surface member 61B' and the positioning wall 55. For this reason, a load applied from the hard surface member 61B' near the positioning wall 55 to the developing roller 31 increases.

Therefore, like this embodiment, if the side surface of the surface member 61B is disposed at a position away from the positioning wall 55, the protrusion 56, and the support portion 54, a load applied to the developing roller 31 can be reduced, and the developing roller 31 can be prevented from being damaged.

As shown in FIG. 3, the blade seal member 62 is provided at both ends of the layer thickness regulating blade 32 so as to come into close contact with the left and right edges of the pressing member 32D of the layer thickness regulating blade 32, and adjacent to the side seal member 61 in the rotation direction of the developing roller 31. As shown in FIG. 5A, the blade seal member 62 is formed by pasting a base material 62A and a surface member 62B thinner than the base material 62A by a double-sided tape or the like, similarly to the above-described side seal member 61. The base material 62A is attached to the layer thickness regulating blade 32 by a double-sided tape, such that the blade seal member 62 is fixed to the layer thickness regulating blade 32.

The surface member 62B is formed longer than the base material 62A in the rotation direction of the developing roller 31. Only the surface member 62B is bent from the leading end of the layer thickness regulating blade 32 (metal plate 32A) and curves from the front surface to the rear surface. With this structure, the blade seal member 62 is prevented from being peeled off due to the rotation of the developing roller 31.

As described above, if it is configured such that only the surface member 62B curves to the rear surface of the layer thickness regulating blade 32, a step between the rear surface of the layer thickness regulating blade 32 and the thin surface member 62B can be minimized. For this reason, the blade rear seal member 64 disposed at the rear of the layer thickness regulating blade 32 can be deformed so as to follow the small step surface, and thus toner leakage from around the step is suppressed.

The bent portion of the surface member 62B comes into contact with the upper end of the adjacent side seal member 61 (the base material 61A and the surface member 61B). With this structure, toner leakage from between the side seal member 61 and the blade seal member 62 is reliably suppressed.

As shown in FIG. 4, the lower film 63 is a sheet-like member formed of resin, such as polyethylene terephthalate or the like. The lower film 63 extends in the axial direction of the developing roller 31 and comes into slide contact with the substantially entire developing roller 31. The lower film 63 is formed longer than the support portion 54 in the left-right direction, and in a state where the lower film 63 is attached to the support portion 54, both ends thereof protrude from the support portion 54 so as to overlap the side seal member 61 and to be opposite the side seal attachment surface 53. Thus, the above-described gap G2 (see FIG. 6) is formed.

As shown in FIG. 3, a concave developer receiving portion 70 with an opening only on the upper side is formed on the rear side of the side seal member 61 (on the upstream side in the rotation direction of the developing roller 31). Specifically, the developer receiving portion 70 is formed by the side seal attachment surface 53, the support portion 54, an outer wall portion 73 which is disposed outside the side seal attachment surface 53 in the left-right direction, the side seal member 61, and a flexible sheet member 75 which is attached along the lower end of the developing unit housing 50. With this structure, when toner on the blade seal member 62 is temporarily trapped by the developing roller 31 and transported toward the side seal member 61, even though toner is scrapped at the edge of the side seal member 61 and falls down, toner can be received by the developer receiving portion 70. Therefore, toner leakage from the developing cartridge 28 can be suppressed.

With this configuration, this embodiment can obtain the following advantages. If the filler F is filled in the gap G2 surrounded by the lower film 63, the side seal member 61, the support portion 54, and the side seal attachment surface 53, the filler F which flows so as to spread on the side seal attachment surface 53 is stopped by the protrusion 56. For this reason, there is no case where the filler F wastefully spreads on the side seal attachment surface 53, and thus consumption of the filler F can be reduced.

The side seal member 61 comes into contact with the protrusion 56 which suppresses the spread of the filler F so as to position the side seal member 61. Therefore, the structure can be simplified, as compared with a case where a positioning protrusion is additionally provided.

The opposing surface (inclined surface 56A) of the protrusion 56 suppressing the spread of the filler F with respect to the support portion 54 is inclined so as to be close to the support portion 54 with a decreasing distance to the side seal member 61. Therefore, the nozzle N for injecting the filler F can be reliably guided to the gap G2.

The blade seal member 62 is provided so as to be bent from the leading end of the layer thickness regulating blade 32 and to curve from the front surface to the rear surface, so there is no case where the blade seal member 62 is peeled off due to the rotation of the developing roller 31. Therefore, toner leakage can be suppressed.

Only the surface member 62B of the blade seal member 62 curves to the rear surface of the layer thickness regulating blade 32, so a step between the portion (surface member 62B) which curves to the rear surface and the rear surface of the layer thickness regulating blade 32 can be minimized. For this reason, a gap is unlikely to be formed between the periphery of the portion (surface member 62B) which curves to the rear surface and the blade rear seal member 64 disposed on the rear surface of the layer thickness regulating blade 32. Therefore, toner leakage can be suppressed.

The bent portion of the surface member 62B of the blade seal member 62 comes into contact with the end of the side seal member 61. Therefore, toner leakage from between the side seal member 61 and the blade seal member 62 can be reliably suppressed.

The blade rear seal member 64 is formed longer than the length of the layer thickness regulating blade 32 in the longitudinal direction and protrudes from both ends 32E of the layer thickness regulating blade 32. For this reason, the minute gap G1 between the crushed blade rear seal member 64 and the step portion of the layer thickness regulating blade 32 is blocked by both ends 64A of the blade rear seal member 64. Therefore, toner leakage can be reliably suppressed.

The side surface of the surface member 61B of the side seal member 61 is disposed inward from the side surface of the base material 61A so as to be away from the walls, such as the positioning wall 55 and the like. For this reason, when the developing roller 31 is pressed against the side seal member 61, the soft base material 61A protrudes from the gap between the surface member 61B and the positioning wall 55 or the like so as to come into elastic contact with the developing roller 31. Therefore, the developing roller 31 can be prevented from being damaged.

The invention is not limited to the above-described embodiment, and other embodiments are possible.

Although in the above-described embodiment, the developing cartridge 28 having the toner containing chamber 34 as a single body is used as a developing device, the invention is not limited thereto. For example, a cartridge in which a toner cartridge having a toner containing chamber is detachably mounted may be used as a developing device.

Although in the above-described embodiment, the two-layered side seal member 61 is used as a side seal member, the invention is not limited thereto. For example, a single-layered or a three or more-layered side seal member may be used.

Although in the above-described embodiment, the lower film 63 made of resin is used as an elongated seal member, the invention is not limited thereto. For example, sheet-like urethane sponge or the like may be used.

Although in the above-described embodiment, a portion of the opposing surface of the protrusion 56 with respect to the support portion 54 has the inclined surface 56A, the invention is not limited thereto. For example, the entire opposing surface may be an inclined surface.

Although in the above-described embodiment, the two-layered blade seal member 62 is used as a blade seal member, the invention is not limited thereto. For example, a single-layered or a three or more-layered blade seal member may be used.

Although in the above-described embodiment, only the surface member 62B of the blade seal member 62 curves to the rear surface of the layer thickness regulating blade 32, the invention is not limited thereto. For example, the base material 61A may have the same length as the surface member 62B, and the base material 61A and the surface member 62B may curve to the rear surface together. Alternatively, the base material 61A may be formed longer than the surface member 62B, and only the base material 61A may curve to the rear surface.

Although in the above-described embodiment, the side seal member 61 is structured such that the side surface of the surface member is disposed inward from the side surface of the base material, the invention is not limited thereto. For example, the blade seal member 62 or the like may be structured as above. That is, the side surface of the surface member 62B may be disposed inward from the side surface of the base material 62A facing the pressing member 32D.

Figure 9:
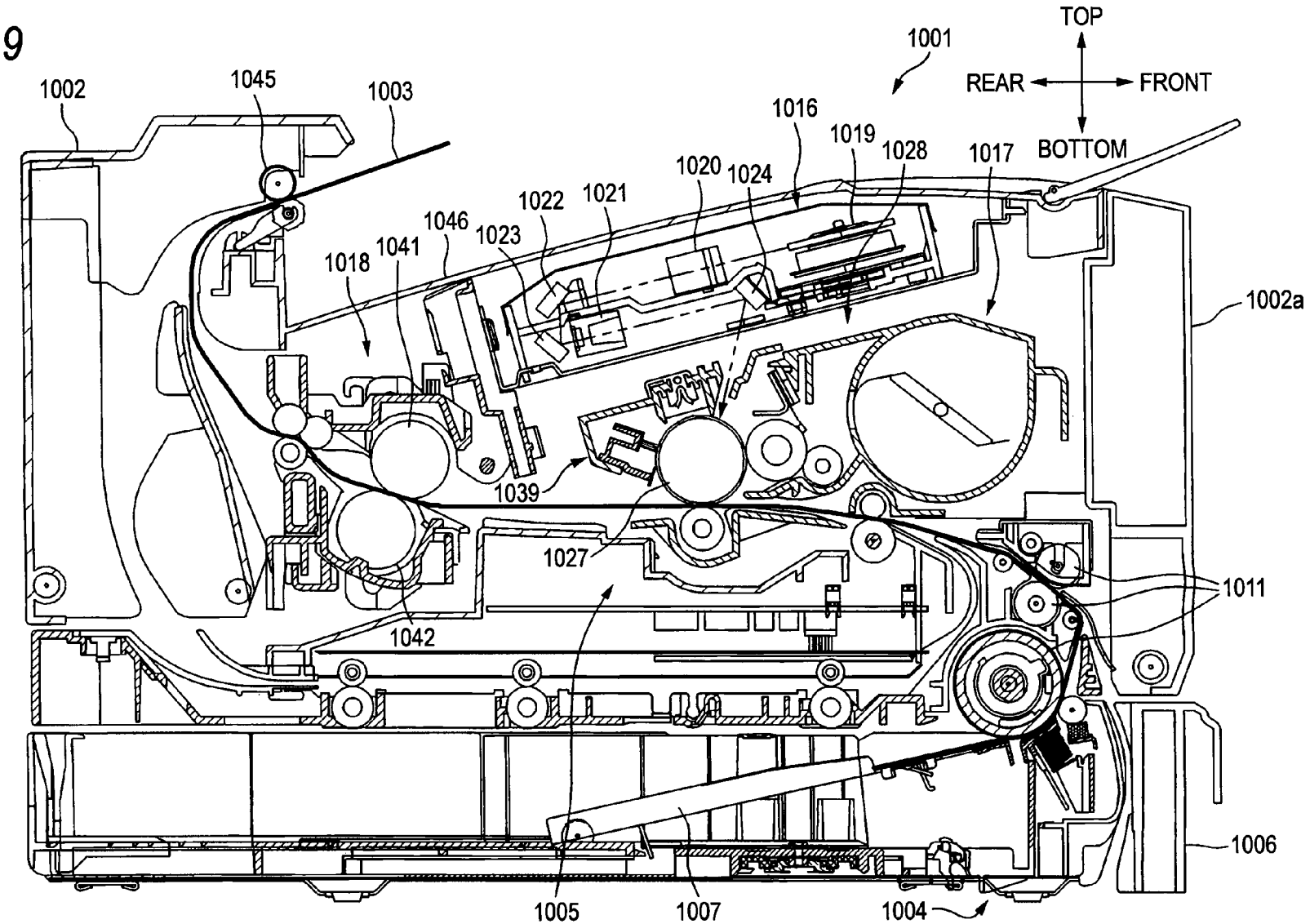
FIG. 9 is a side sectional view showing a laser printer having a developing cartridge according to a second embodiment of the invention.
Figure 10:
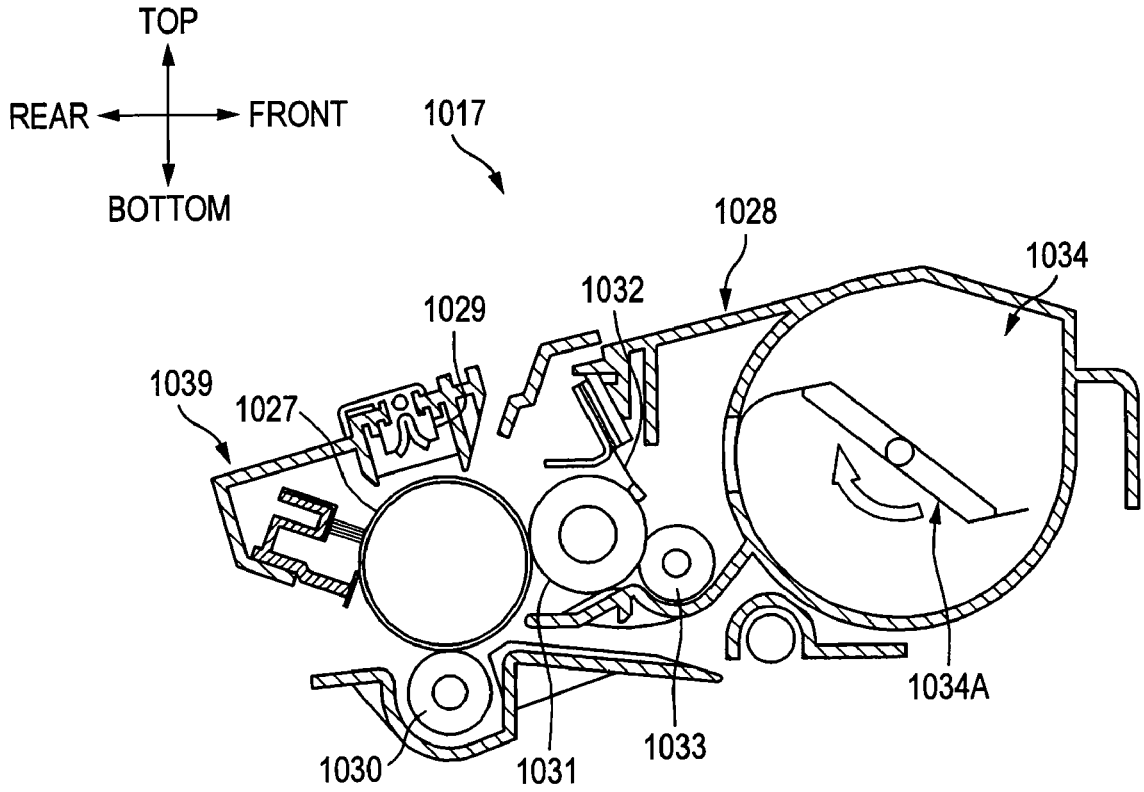
FIG. 10 is a side sectional view showing a developing cartridge.

Next, a second embodiment of the invention will be described in detail with reference to the drawings. FIG. 9 is a side sectional view showing a laser printer having a developing cartridge according to an embodiment of the invention. FIG. 10 is a side sectional view showing a developing cartridge. In the following description, after brief description of the overall configuration of the laser printer, details of the configuration will be described.

In the following description, directions are defined as viewed from a user when using a laser printer 1001. That is, in FIG. 9, the right side is referred to as the "front side", the left side is referred to as the "rear side", the rear side in the direction perpendicular to the paper is referred to as the "right side", and the front side in the direction perpendicular to the paper is referred to as the "left side". The up-down direction is referred to as the "up-down direction" since the direction in the drawing matches the direction of the user when using the laser printer.

<Overall Configuration of Laser Printer>

As shown in FIG. 9, the laser printer 1001 includes, in a main body casing 1002, a feeder unit 1004 for feeding a sheet 1003, an image forming unit 1005 for forming an image on the sheet 1003, and the like.

<Configuration of Feeder Unit>

The feeder unit 1004 includes a sheet feed tray 1006 which is detachably mounted at the bottom of the main body casing 1002, and a sheet pressing plate 1007 which is provided in the sheet feed tray 1006. The feeder unit 1004 also includes various rollers 1011 for transporting the sheet 1003 or removing paper dust. In the feeder unit 1004, the sheet 1003 in the sheet feed tray 1006 is tilted upward by the sheet pressing plate 1007 and transported to the image forming unit 1005 by various rollers 1011.

<Configuration of Image Forming Unit>

The image forming unit 1005 includes a scanner unit 1016, a process cartridge 1017, a fixing unit 1018, and the like.

<Configuration of Scanner Unit>

The scanner unit 1016 is provided at the upper portion of the main body casing 1002, and includes a laser light emitting unit (not shown), a polygon mirror 1019 which is driven to rotate, lenses 1020 and 1021, reflecting mirrors 1022, 1023, and 1024, and the like. In the scanner unit 1016, a laser beam is irradiated onto the surface of a photosensitive drum 1027 through a path indicated by a chain line in the drawing by high-speed scanning.

<Configuration of Process Cartridge>

The process cartridge 1017 is detachably mounted in the main body casing 1002 after appropriately opening a front cover 1002*a* provided on the front side of the main body casing 1002. The process cartridge 1017 mainly includes a developing cartridge 1028 as an example of a developing device and a drum unit 1039.

The developing cartridge 1028 is detachably mounted in the main body casing 1002 while being mounted on the drum unit 1039. The developing cartridge 1028 may be detachably mounted on the drum unit 1039 fixed to the main body casing 1002. As shown in FIG. 10, the developing cartridge 1028 mainly includes a developing roller 1031 as an example of a developer carrier, a layer thickness regulating blade 1032, a supply roller 1033, and a toner containing chamber 1034.

In this developing cartridge 1028, toner as an example of a developer in the toner containing chamber 1034 is stirred by an agitator 1034A and then supplied to the developing roller 1031 by the supply roller 1033. At this time, toner is positively frictionally charged between the supply roller 1033 and the developing roller 1031. Toner supplied onto the developing roller 1031 enters between the layer thickness regulating blade 1032 and the developing roller 1031 by the rotation of the developing roller 1031 and is then carried on the developing roller 1031 in the form of a thin film with a uniform thickness. The details of the developing cartridge 1028 will be described below.

The drum unit 1039 mainly includes a photosensitive drum 1027, a Scorotron-type charger 1029, and a transfer roller 1030. In the drum unit 1039, the surface of the photosensitive drum 1027 is positively charged uniformly by the Scorotron-type charger 1029 and then exposed by high-speed scanning of laser beams from the scanner unit 1016. In this way, the potential of the exposed portion falls down, and an electrostatic latent image based on image data is formed.

Next, toner carried on the developing roller 1031 is supplied to the electrostatic latent image formed on the surface of the photosensitive drum 1027 by the rotation of the developing roller 1031, and a toner image is formed on the surface of the photosensitive drum 1027. Thereafter, the sheet 1003 is transported between the photosensitive drum 1027 and the transfer roller 1030, and the toner carried on the surface of the photosensitive drum 1027 is transferred to the sheet 1003.

<Configuration of Fixing Unit>

As shown in FIG. 9, the fixing unit 1018 includes a heating roller 1041, and a pressing roller 1042 which is disposed to be opposite the heating roller 1041 so as to press the heating roller 1041. In the fixing unit 1018 configured as above, toner transferred onto the sheet 1003 is thermally fixed while the sheet 1003 passes through between the heating roller 1041 and the pressing roller 1042. The sheet 1003 thermally fixed by the fixing unit 1018 is transported to a sheet discharge roller 1045 provided on the downstream side of the fixing unit 1018 and then delivered from the sheet discharge roller 1045 onto a sheet discharge tray 1046.

<Detailed Structure of Developing Cartridge>

Figure 11A:
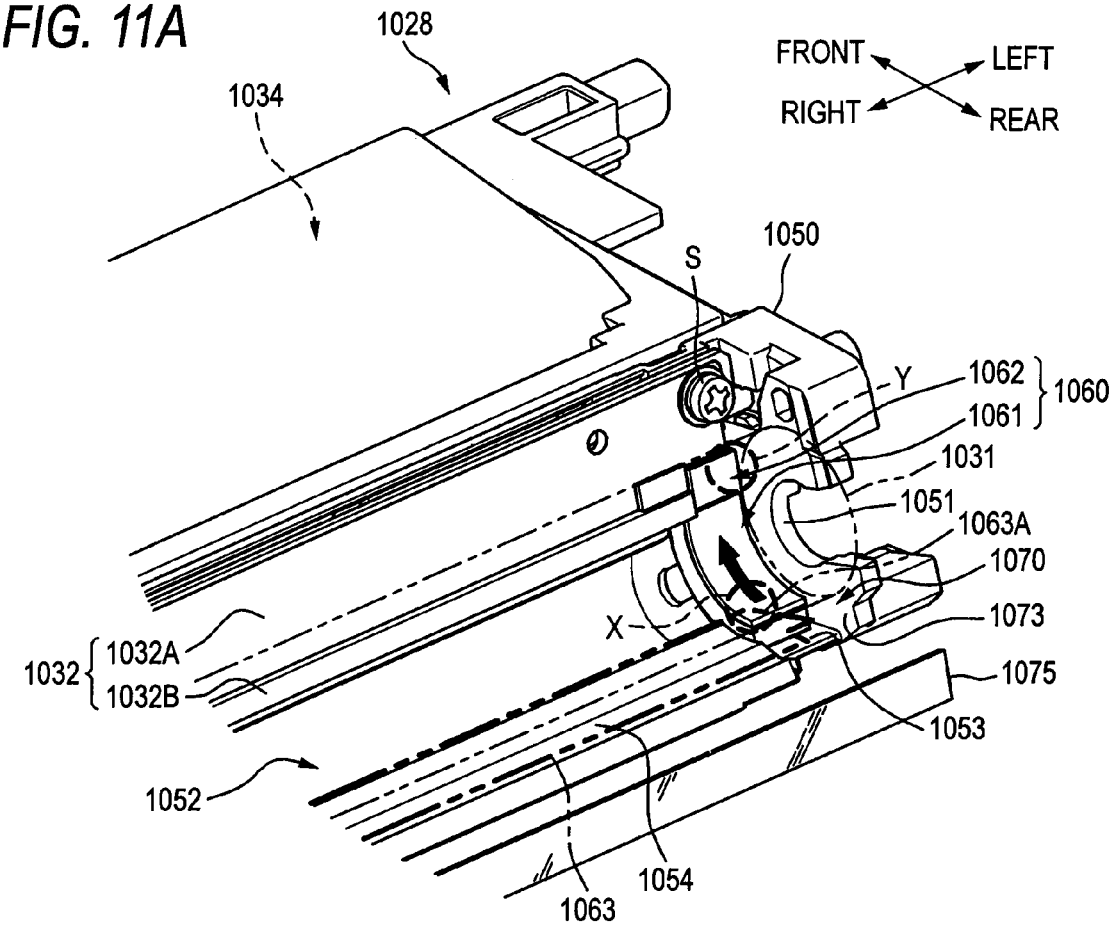
FIGS. 11A to 11D show the structure around a side seal member.
Figure 11B:
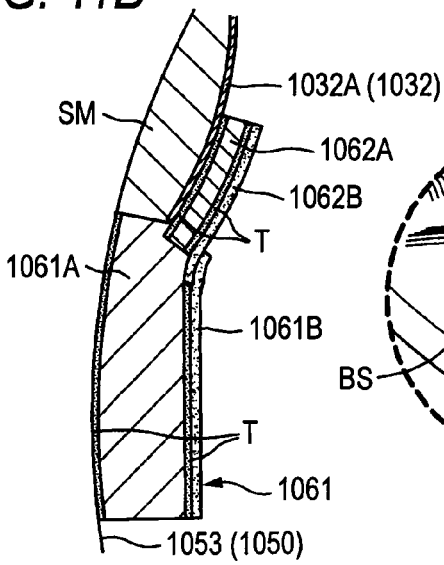
Figure 11C:
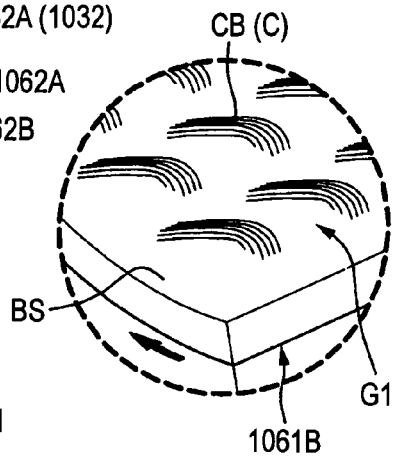
Figure 11D:
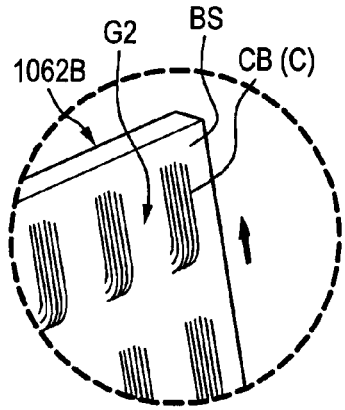
Figure 12:
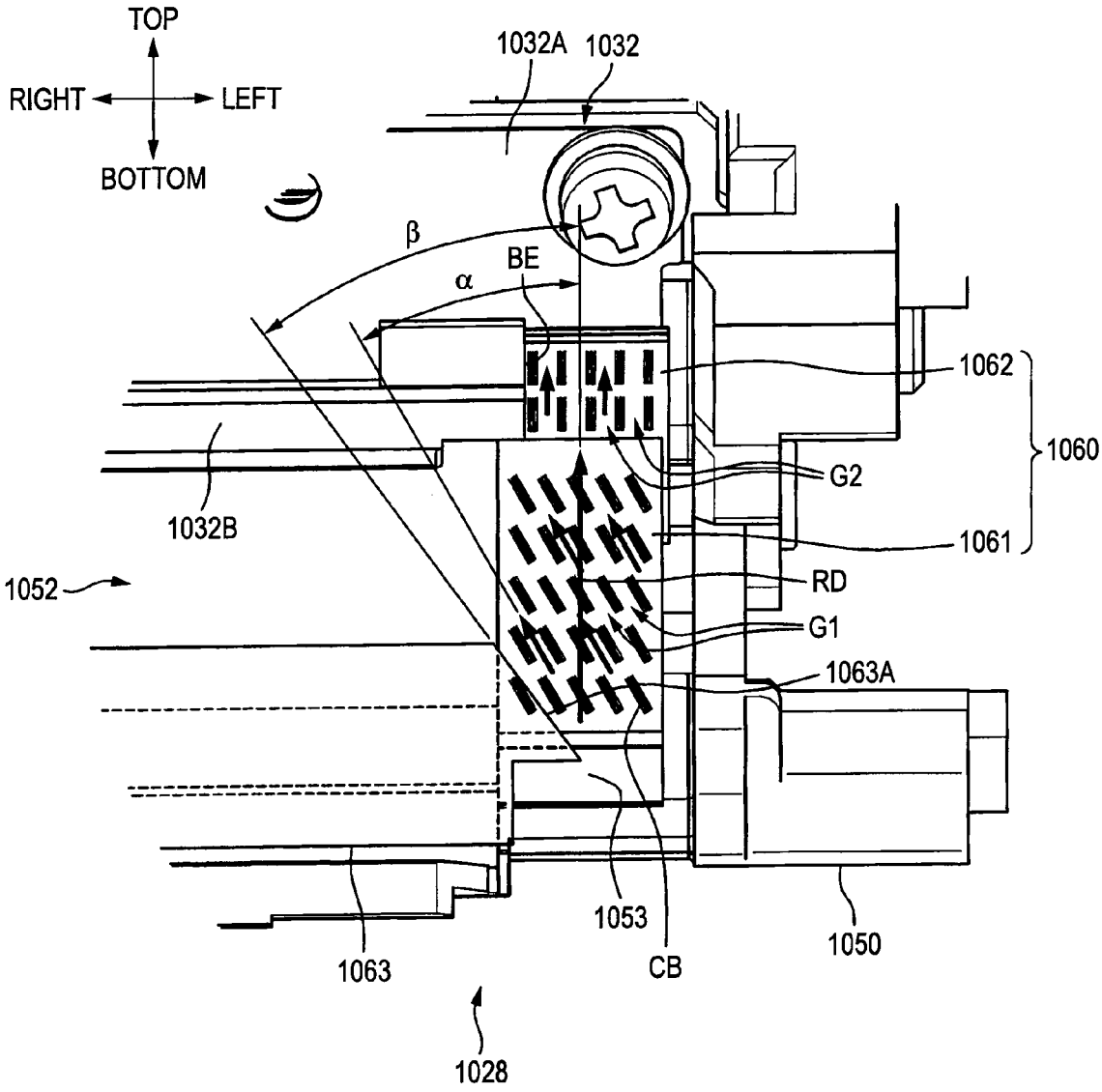
FIG. 12 is a front view showing the delivery direction of toner by an upstream-side seal and a downstream-side seal and the angle of both edges of a lower film.

Next, the detailed structure of the developing cartridge 1028 according to an embodiment of the invention will be described. FIG. 11A is an enlarged perspective view showing the structure around a side seal member, FIG. 11B is a sectional view showing details of a side seal member, FIG. 11C is an enlarged perspective view of an X portion in FIG. 11A, and FIG. 11D is an enlarged perspective view of a Y portion in FIG. 11A. FIG. 12 is a front view showing the delivery direction of toner by an upstream-side seal and a downstream-side seal, and the angle of both edges of a lower film. The developing cartridge 1028 has a symmetric structure in the left-right direction. Therefore, in FIGS. 11A to 11D and 12, only the left side is shown, and the right side is not shown. FIGS. 11A to 11D and 12 show a state where the developing roller 1031 or the supply roller 1033 is removed.

As shown in FIG. 11A, the developing cartridge 1028 includes, in addition to the above-described developing roller 1031 and the like, a developing unit housing 1050 which rotatably supports the developing roller 1031, a side seal member 1060 which comes into slide contact with both ends of the developing roller 1031, and a lower film 1063 as an example of an elongated seal member.

The developing unit housing 1050 mainly includes a bearing portion 1051 which rotatably supports the developing roller 1031, a supply port 1052 for supplying toner from the internal toner containing chamber 1034 to the developing roller 1031, and attachment surfaces 1053 which are formed on the left and right sides of the supply port 1052 to have a substantially arc shape in side view. The supply port 1052 is formed in a rectangular long hole shape in the axial direction of the developing roller 1031. A support portion 1054 for supporting the lower film 1063 is formed below the supply port 1052 so as to protrude toward the developing roller 1031 from the attachment surfaces 1053, and the layer thickness regulating blade 1032 is fixed above the supply port 1052.

The layer thickness regulating blade 1032 mainly includes a metal plate 1032A, the upper end of which is fixed to the developing unit housing 1050, and a pressing member 1032B which is made of rubber and is an example of a pressing portion fixed to the lower edge (front edge) of the metal plate 1032A. The metal plate 1032A is formed so as to protrude outward in the left-right direction from the edges on the left and right sides of the supply port 1052, and corner portions above both ends are fixed to the developing unit housing 1050 by screws S. The pressing member 1032B is formed so as to protrude outward in the left-right direction from the edges on the left and right sides of the supply port 1052 such that both edges are disposed inward in the left-right direction from the edges on the left and right sides of the metal plate 1032A (see FIG. 12). The pressing member 1032B comes into slide contact with the peripheral surface of the developing roller 31 while being pressed by a pressing force from the metal plate 1032A.

The side seal member 1060 is provided between both ends of the developing roller 1031 and the attachment surface 1053 adjacent to the left and right sides of the supply port 1052 in the developing unit housing 1050. The side seal member 1060 mainly includes an upstream-side seal 1061 and a downstream-side seal 1062.

As shown in FIG. 11B, the upstream-side seal 1061 includes an elastic base material 1061A, and a surface member 1061B which is provided on the surface of the base material 1061A facing the developing roller 1031. The base material 1061A is formed of an elastic material, such as urethane sponge or the like, and is directly attached to the attachment surface 1053 of the developing unit housing 1050 by a double-sided tape T.

As shown in FIG. 11C, the surface member 1061B is formed by implanting a plurality of fibers C into a base sheet BS, and is attached to the base material 1061A by a double-sided tape T. Specifically, the surface member 1061B is configured such that a plurality of fiber bundles CB each having a plurality of fibers C are arranged at predetermined intervals, and each fiber bundle CB is tilted toward the supply port 1052 in an oblique direction with a decreasing distance to the downstream side in the rotation direction of the developing roller 1031 (an arrow indicated by a bold line in the drawing). Especially, a plurality of columns each having a plurality of fiber bundles CB arranged in the above-described oblique direction at intervals are arranged at intervals. With this configuration, a first guide path G1 through which toner is delivered in the above-described oblique direction is formed between the fiber bundles CB in the surface member 1061B. As shown in FIG. 12, the upstream-side seal 1061 configured as above is formed to have a width larger than the width of the downstream-side seal 1062 in the left-right direction so as to extend toward the supply port 1052 from the downstream-side seal 1062.

The surface member 1061B is formed by implanting a plurality of fiber bundles CB into a single sheet material, then continuing to tilting the fiber bundles CB in a predetermined direction for a predetermined time to curl the fiber bundles CB, and subsequently cutting the sheet material into a plurality of base sheets BS horizontally and vertically. For this reason, the fibers can be formed such that the fiber tip does not protrude from the base sheet BS, as compared with a method in which the sheet material is cut into a plurality of base sheets BS, and then the fiber bundles CB are curled. If the fiber tip does not protrude from the base sheet BS, there is no case where toner on the developing roller 1031 is trapped by the fiber tip protruding from the base sheet BS into the supply port 1052. Therefore, toner can be satisfactorily carried within the image forming range on the developing roller 1031.

For convenience of description, in FIGS. 11A to 11D and 12, the length of the implanted fiber C or the width between the fiber bundles CB is shown large. The length of the fiber C may be shorter than that in the drawing, and the fiber bundles CB may be arranged over the entire surface with no interval.

The downstream-side seal 1062 is provided on the downstream side in the rotation direction of the developing roller 1031 with respect to the upstream-side seal 1061. As shown in FIG. 11B, the downstream-side seal 1062 includes an elastic base material 1062A, and a surface member 1062B which is provided on the surface of the base material 1062A facing the developing roller 1031. The base material 1062A is formed of an elastic material, such as urethane sponge or the like. The base material 1062A is attached to the metal plate 1032A by a double-sided tape T so as to protrude toward the upstream side of the metal plate 1032A of the layer thickness regulating blade 1032.

As shown in FIG. 11D, similarly to the surface member 1061B of the upstream-side seal 1061, the surface member 1062B includes a plurality of fiber bundles CB and a base sheet BS. The surface member 1062B is configured such that the fiber bundles CB are tilted in a direction different from that of the surface member 1061B of the upstream-side seal 1061. That is, the surface member 1062B is configured such that a plurality of columns each having a plurality of fiber bundles CB arranged at intervals in the rotation direction of the developing roller 1031 are arranged at intervals in the axial direction of the developing roller 1031, and the fiber bundles CB are tilted toward the downstream side in the rotation direction of the developing roller 1031. With this configuration, in the surface member 1062B, a second guide path G2 through which toner is delivered to the downstream side in the rotation direction is formed between the fiber bundles CB.

As shown in FIG. 11B, the surface member 1062B is formed longer than the base material 1062A in the rotation direction so as to protrude toward the upstream side in the rotation direction from the base material 1062A. A portion of the surface member 1062B which protrudes toward the upstream side in the rotation direction from the base material 1062A is disposed between the base material 1061A of the upstream-side seal 1061 and the surface member 1061B. With this structure, the surface member 1061B of the upstream-side seal 1061 overlaps the surface member 1062B of the downstream-side seal 1062.

As shown in FIG. 12, the downstream-side seal 1062 (the base material 1062A and the surface member 1062B) configured as above is provided on the layer thickness regulating blade 1032 so as to come into close contact with the left and right edges BE of the pressing member 1032B of the layer thickness regulating blade 1032. As shown in FIG. 11B, a seal material SM different from the side seal member 1060 is provided between the layer thickness regulating blade 1032 (metal plate 1032A) and the attachment surface 1053 of the developing unit housing 1050.

The side seal member 1060 configured as above is attached to the layer thickness regulating blade 1032 (metal plate 1032A) in a suspensible state before the layer thickness regulating blade 1032 is attached to the developing unit housing 1050. For this reason, the layer thickness regulating blade 1032 is fixed to the developing unit housing 1050 by screws S, and the base material 1061A of the upstream-side seal 1061 is attached to the attachment surface 1053 of the developing unit housing 1050, so the layer thickness regulating blade 1032 and the side seal member 1060 can be simply attached to the developing unit housing 1050.

As shown in FIG. 11A, the lower film 1063 is a sheet-like member made of resin, such as polyethylene terephthalate. The lower film 1063 extends in the axial direction of the developing roller 1031 and comes into slide contact with the substantially entire developing roller 1031. The lower film 1063 is formed longer than the support portion 1054 in the left-right direction, and in a state where the support portion 1054 is attached to the support portion 1054, both ends thereof protrude from the support portion 1054 so as to overlap the upstream-side seal 1061 (side seal member 1060).

As shown in FIG. 12, the edges 1963A (hereinafter, also referred to as "both edges 1063A) at both ends of the lower film 1063 overlapping the upstream-side seal 1061 are formed in an oblique direction toward the supply port 1052 with a decreasing distance to the downstream side in the rotation direction of the developing roller 1031. Specifically, the angle β of both edges 1063A of the lower film 1063 with respect to an arrow RD in the drawing (the rotation direction of the developing roller 1031) is larger than the angle α of the delivery direction of toner by the upstream-side seal 1061 (the angle of the fiber CB) with respect to the arrow RD. With this structure, toner moving on the upstream-side seal 1061 returns to the supply port 1052, not remaining at both edges 1063A of the lower film 1063. In FIG. 12, for ease of understanding of the comparison of the angle β of both edges 1063A of the lower film 1063 and the angle α of the fiber CB, the shape of the lower film 1063 or the orientation of the fiber bundle CB is simply shown.

As shown in FIG. 11A, a concave developer receiving portion 1070 with an opening only on the upper side is formed on the rear side of the upstream-side seal 1061 (the upstream side in the rotation direction of the developing roller 1031). Specifically, the developer receiving portion 1070 is formed by the attachment surface 1053, the support portion 1054, an outer wall portion 1073 which is disposed outside the attachment surface 1053 in the left-right direction, the upstream-side seal 1061, and a flexible sheet member 1075 which is attached along the lower end of the developing unit housing 1050. With this structure, when toner on the downstream-side seal 1062 is temporarily trapped by the developing roller 1031 and transported toward the upstream-side seal 1061, even though toner is scrapped at the edge of the upstream-side seal 1061 and falls down, toner can be received by the developer receiving portion 1070. Therefore, toner leakage from the developing cartridge 1028 can be suppressed.

Next, the operation of the side seal member 1060 of this embodiment will be described. As shown in FIG. 11A, while the developing roller 1031 is rotating, when toner enters the upstream-side seal 1061, as shown in FIG. 12, toner on the upstream-side seal 1061 is pressed against the rotating developing roller 1031 and moved along the first guide path G1 between the fiber bundles CB obliquely tilted (or between a plurality of fibers C constituting the fiber bundles CB). At this time, toner smoothly moves toward the supply port 1052 and returns to the supply port 1052, without being trapped at both edges 1063A of the lower film 1063.

When toner enters the downstream-side seal 1062, toner on the downstream-side seal 1062 is pressed against the rotating developing roller 1031 and moved along the second guide path G2 between the fiber bundles CB tilted toward the downstream side (or between a plurality of fibers C constituting the fiber bundles CB) along the rotation direction. When this happens, toner is carried on the developing roller 1031 while moving on the downstream-side seal 1062 toward the downstream side along the rotation direction and returns to the upstream-side seal 1061. Thereafter, as described above, toner obliquely moves on the upstream-side seal 1061 and returns to the supply port 1052.

According to the above-described configuration, this embodiment can obtain the following advantages. Even though toner enters the surface of the upstream-side seal 1061, toner can be returned to the supply port 1052 by the upstream-side seal 1061 which obliquely delivers toner, so toner leakage can be suppressed. Further, there is no case where toner remains at both edges 1063A of the lower film 1063, so toner can be prevented from leaking or the developing roller 1031 can be prevented from being damaged due to toner remaining at both edges 1063A of the lower film 1063.

The angle β of both edges 1063A of the lower film 1063 with respect to the rotation direction (arrow RD) is larger than the angle α of the delivery direction of toner by the upstream-side seal 1061 with respect to the rotation direction. Therefore, toner can be reliably prevented from remaining at both edges 1063A of the lower film 1063.

When toner enters the downstream-side seal 1062, toner is carried on the developing roller 1031 while being moved on the downstream-side seal 1062 toward the downstream side along the rotation direction, and returns to the upstream-side seal 1061. Therefore, toner can be returned to the supply port 1052 by the upstream-side seal 1061, so toner leakage can be suppressed.

The surface member 1061B of the upstream-side seal 1061 is provided so as to overlap the surface member 1062B of the downstream-side seal 1062. Therefore, the downstream-side seal 1062 can be prevented from being peeled off due to the rotation of the developing roller 1031.

The downstream-side seal 1062 comes into close contact with the left and right edges BE of the pressing member 1032B of the layer thickness regulating blade 1032. Therefore, toner leakage from between the downstream-side seal 1062 and the left and right edges BE of the pressing member 1032B can be suppressed.

The upstream-side seal 1061 extends to the supply port 1052 from the downstream-side seal 1062. Therefore, the flow of toner from the supply port 1052 into between the left and right edges BE of the pressing member 1032B and the downstream-side seal 1062 can be suppressed by the extended portion of the upstream-side seal 1061.

The concave developer receiving portion 1070 is formed on the upstream side of the upstream-side seal 1061. For this reason, even though toner delivered from the downstream-side seal 1062 by the developing roller 1031 is temporarily cut at the edge of the upstream-side seal 1061 and falls down, toner can be received by the developer receiving portion 1070. Therefore, toner leakage from the developing cartridge 1028 can be suppressed.

The guide paths G1 and G2 having a comparatively large width can be formed between the fiber bundles CB tilted in a predetermined direction, so toner can be smoothly delivered in a predetermined direction. It is preferable that the fiber bundles CB be formed to have such a length that the fiber tip comes into contact with the root of an adjacent fiber bundle CB. With this structure, toner can be prevented from flowing into another guide path adjacent to one guide path. Therefore, the flow of toner can be smoothened, so toner can more satisfactorily return to the supply port 1052.

The base material 1062A of the downstream-side seal 1062 is attached so as to protrude to the upstream side of the metal plate 1032A of the layer thickness regulating blade 1032. Therefore, toner leakage between the base material 1061A of the upstream-side seal 1061 and the surface member 1062B of the downstream-side seal 1062 can be suppressed.

The invention is not limited to the above-described embodiment, and other embodiments are possible.

Although in the above-described embodiment, the fiber bundles CB are tilted in a predetermined direction so as to deliver toner in a predetermined direction, the invention is not limited thereto. For example, a plurality of columns each having a plurality of fiber bundles which stand upright with respect to the base sheet are arranged to be close to each other in a predetermined direction (the above-described oblique direction or the direction toward the downstream side in the rotation direction), thereby delivering toner in a predetermined direction. Alternatively, exposed strings of a fabric on the developing roller 1031 side are woven so as to be arranged in a predetermined direction (the above-described oblique direction or the direction toward the downstream side in the rotation direction), thereby delivering toner in a predetermined direction.

Although in the above-described embodiment, the surface member 1062B of the downstream-side seal 1062 protrudes toward the upstream side from the base material 1062A, the invention is not limited thereto. For example, the surface member 1061B of the upstream-side seal 1061 may be formed so as to protrude from the base material 1061A toward the downstream side. In this case, the surface member 1061B of the upstream-side seal 1061 can overlap the surface member 1062B of the downstream-side seal 1062. Therefore, the downstream-side seal 1062 can be prevented from being peeled off due to the rotation of the developing roller 1031.

Although in the above-described embodiment, the downstream-side seal 1062 is attached to the metal plate 1032A of the layer thickness regulating blade 1032, the invention is not limited thereto. For example, when the metal plate 1032A of the layer thickness regulating blade 1032 is formed to have the same dimension as the pressing member 1032B in the left-right direction, the downstream-side seal 1062 may be directly attached to the developing unit housing 1050.

Although in the above-described embodiment, the developing cartridge 1028 having the toner containing chamber 1034 as a single body is used as a developing device, the invention is not limited thereto. For example, a cartridge in which a toner cartridge having a toner containing chamber is detachably mounted may be used as a developing device.

Although in the above-described embodiment, toner is delivered through the guide paths G1 and G2 between a plurality of fiber bundles CB tilted in a predetermined direction, the invention is not limited thereto. For example, a plurality of fibers densely formed over the entire base sheet may be tilted in a predetermined direction, such that toner may be delivered along the fibers.

Although in the above-described embodiment, the lower film 1063 made of resin is used as an elongated seal member, the invention is not limited thereto. For example, sheet-like urethane sponge or the like may be used.

<Overall Configuration of Color Printer>

Figure 13:
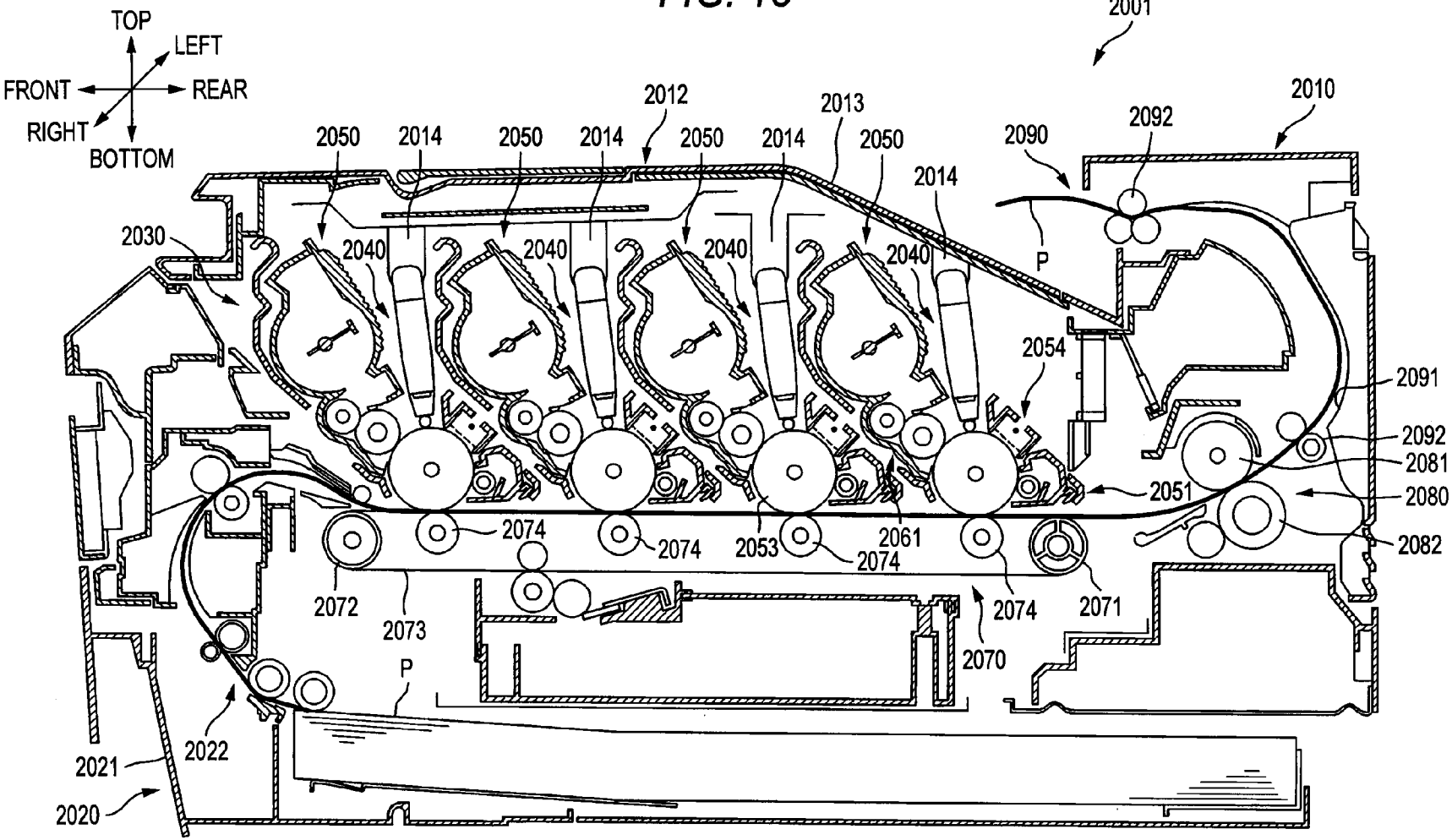
FIG. 13 is a sectional view showing the overall configuration of a color printer as an example of an image forming apparatus having a developing device according to an embodiment of the invention.
Figure 14:
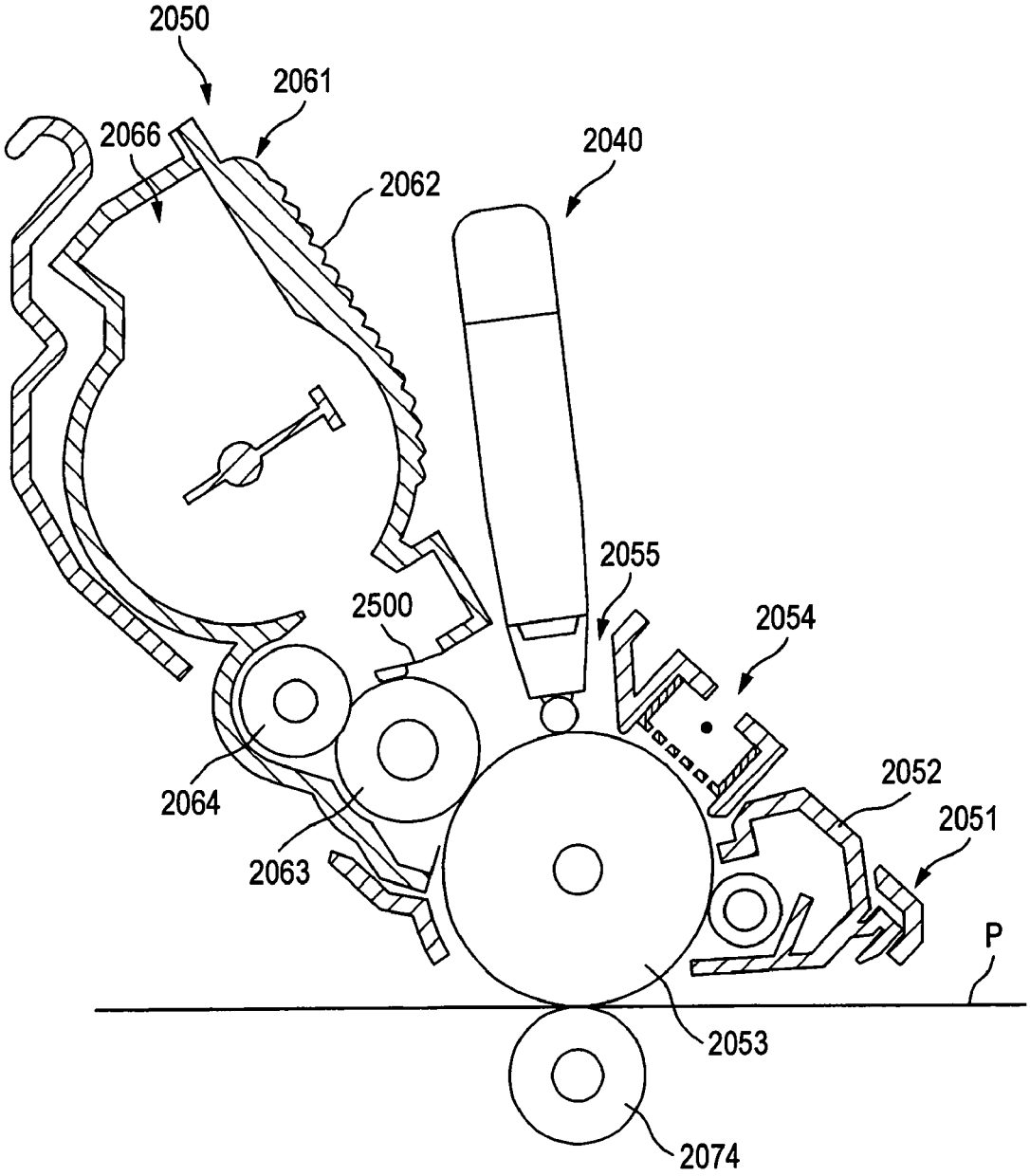
FIG. 14 is an enlarged view of a process cartridge.

Next, a third embodiment of the invention will be described in detail with reference to the drawings. FIG. 13 is a sectional view showing the overall configuration of a color printer as an example of an image forming apparatus having the developing device according to an embodiment of the invention. FIG. 14 is an enlarged view of a process cartridge.

In the following description, directions are defined as viewed from a user when using a color printer. That is, in FIG. 13, the left side with respect to the paper is referred to as the "front" side, the right side with toward the paper is referred to as the "rear" side, the rear side with respect to the paper is referred to as the "left" side, and the front side with respect to the paper is referred to as the "right" side. The up-down direction with respect to the paper is referred to as the "up-down" direction.

As shown in FIG. 13, a color printer 2001 includes, in a main body housing 2010, a sheet feed unit 2020 which feeds a sheet P, an image forming unit 2030 which forms an image on the fed sheet P, and a sheet discharge unit 2090 which discharges the sheet P with the image formed.

A top cover 2012 is provided at the upper portion of the main body housing 2010 so as to be opened/closed in the up-down direction with the rear side as a fulcrum. A sheet discharge tray 2013 is provided at the upper surface of the top cover 2012 so as to accumulate the sheet P discharged from the main body housing 2010, and a plurality of LED holding portions 2014 are provided at the lower surface of the top cover 2012 so as to hold LED units 2040.

The sheet feed unit 2020 is provided at the lower portion of the main body housing 2010, and mainly includes a sheet feed tray 2021 which is detachably mounted in the main body housing 2010, and a sheet feed mechanism 2022 which feeds the sheets P from the sheet feed tray 2021 to the image forming unit 2030. In the sheet feed unit 2020, the sheets P in the sheet feed tray 2021 is separated by the sheet feed mechanism 2022 one by one and supplied to the image forming unit 2030.

The image forming unit 2030 mainly includes four LED units 2040, four process cartridges 2050, transfer units 2070, and a fixing unit 2080.

Each LED unit 2040 is disposed above the corresponding photosensitive drum 2053 so as to be opposite the photosensitive drum 2053 and to expose the surface of the photosensitive drum 2053. The LED unit 2040 is fixed to the top cover 2012 through the LED holding portion 2014, so the LED unit 2040 can be movable together with the top cover 2012.

The process cartridges 2050 are arranged in the front-rear direction between the top cover 2012 and the sheet feed unit 2020, and are detachably mounted with respect to the main body housing 2010 through an opening when the top cover 2012 is open. Each process cartridge 2050 includes a photosensitive unit 2051, and a developing cartridge 2061 as an example of a developing device which is detachably mounted with respect to the photosensitive unit 2051. The process cartridges 2050 have the same configurations, except that the color of toner as an example of a developer contained in a toner containing chamber 2066 (see FIG. 14) of the developing cartridge 2061 differs.

As shown in FIG. 14, the photosensitive unit 2051 mainly includes a photosensitive member case 2052, a photosensitive drum 2053, and a charger 2054. The developing cartridge 2061 is mounted in the photosensitive member case 2052, so an exposure hole 2055 through which the photosensitive drum 2053 is exposed to the outside is formed. The LED unit 2040 is inserted into the exposure hole 2055 above the photosensitive drum 2053 so as to be opposite the photosensitive drum 2053.

The developing cartridge 2061 mainly includes a developing case 2062, a developing roller 2063 as an example of a developer carrier, a supply roller 2064, and a layer thickness regulating blade 2500. The developing cartridge 2061 also has a toner containing portion 2066 which contains toner. Details of the developing cartridge 2061 will be described below.

Returning to FIG. 13, each transfer unit 2070 is provided between the sheet feed unit 2020 and the corresponding process cartridge 2050. The transfer unit 2070 mainly includes a driving roller 2071, a driven roller 2072, a transport belt 2073, and a transfer roller 2074. The driving roller 2071 and the driven roller 2072 are arranged away from each other and in parallel in the front-rear direction, and the endless transport belt 2073 is stretched between the driving roller 2071 and the driven roller 2072. The outer surface of the transport belt 2073 comes into contact with the photosensitive drums 2053, and four transfer rollers 2074 are respectively disposed inside the transfer belt 2073 so as to be opposite the photosensitive drums 2053 with the transfer belt 2073 sandwiched therebetween. A transfer bias is applied to the transfer rollers 2074 during the transfer.

The fixing unit 2080 is disposed at the back of the process cartridges 2050 and the transfer units 2070, and includes a heating roller 2081 and a pressing roller 2082 which is disposed so as to be opposite the heating roller 2081 and presses the heating roller 2081.

In the image forming unit 2030, the surface of each photosensitive drum 2053 is charged uniformly by the charger 2054 and then exposed to light emitted from the LED unit 2040, so an electrostatic latent image based on image data is formed on each photosensitive drum 2053. Toner in the toner containing portion 2066 is supplied from the supply roller 2064 to the developing roller 2063, enters between the developing roller 2063 and the layer thickness regulating blade 2500, and is carried on the developing roller 2063 in the form of a thin layer with a uniform thickness.

Toner carried on the developing roller 2063 is supplied from the developing roller 2063 to the electrostatic latent image on the photosensitive drum 2053. Thus, the electrostatic latent image is visualized, and a toner image is formed on the photosensitive drum 2053. Thereafter, the sheet P fed onto the transfer belt 2073 passes through between the photosensitive drum 2053 and the transfer roller 2074 disposed inside the transfer belt 2073, and the toner images formed on the respective photosensitive drums 2053 are sequentially transferred onto the sheet P in an overlap manner. The sheet P passes through between the heating roller 2081 and the pressing roller 2082, so the toner images transferred onto the sheet P are thermally fixed.

The sheet discharge unit 2090 mainly includes a sheet discharge transport path 2091 which extends upward from the exit of the fixing unit 2080 and turns forward, and a plurality of transport rollers 2092 which transport the sheet P. The sheet P on which the toner images are thermally fixed is transported through the sheet discharge transport path 2091 by the transport rollers 2092, discharged outside the main body housing 2010, and accumulated in the sheet discharge tray 2013.

<Detailed Configuration of Developing Cartridge>

Figure 15:
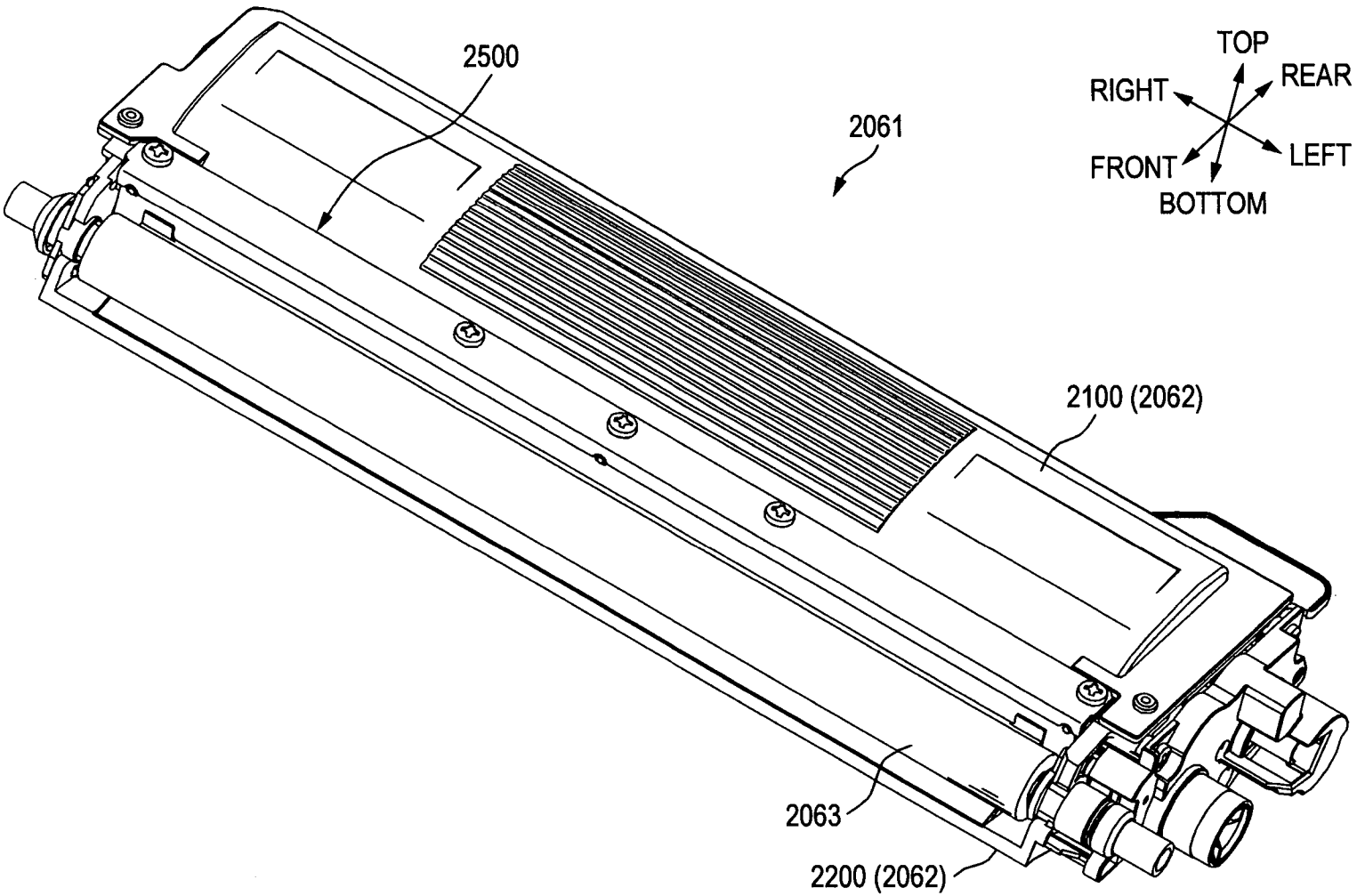
FIG. 15 is a perspective view of a developing cartridge according to an embodiment of the invention.
Figure 16:
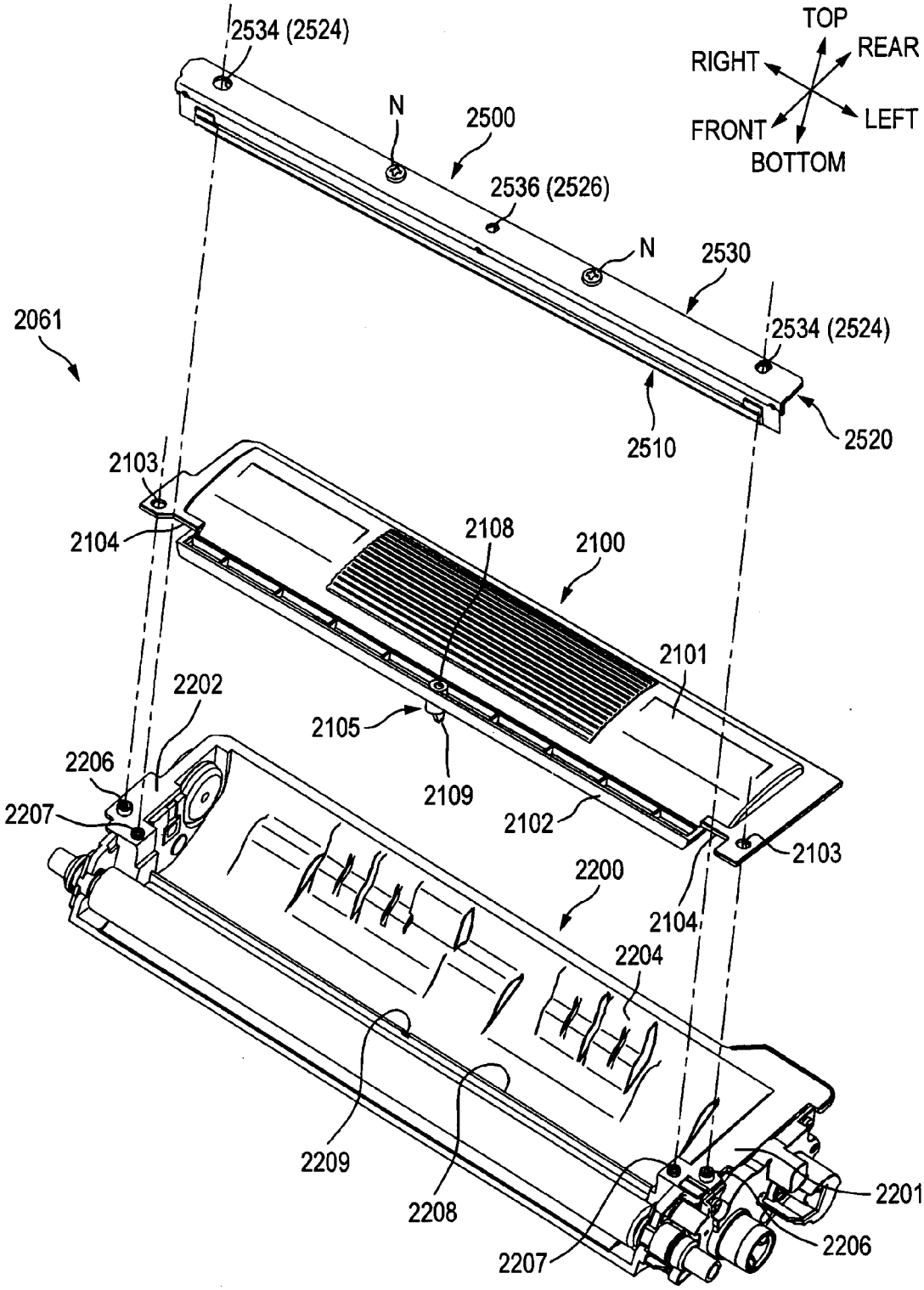
FIG. 16 is an exploded perspective view of a developing cartridge according to an embodiment of the invention.
Figure 17:
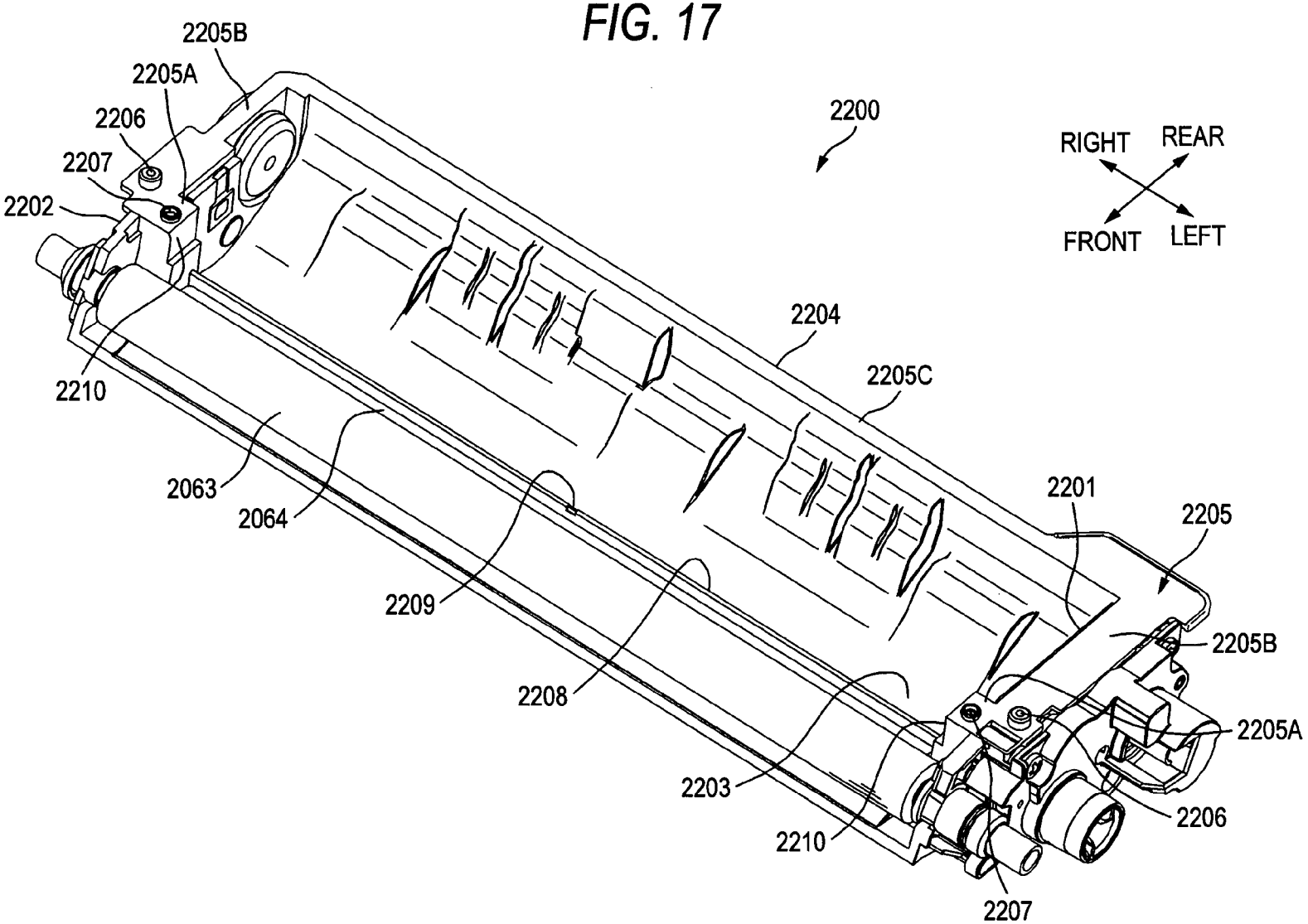
FIG. 17 is a perspective view of a lower frame.
Figure 18:
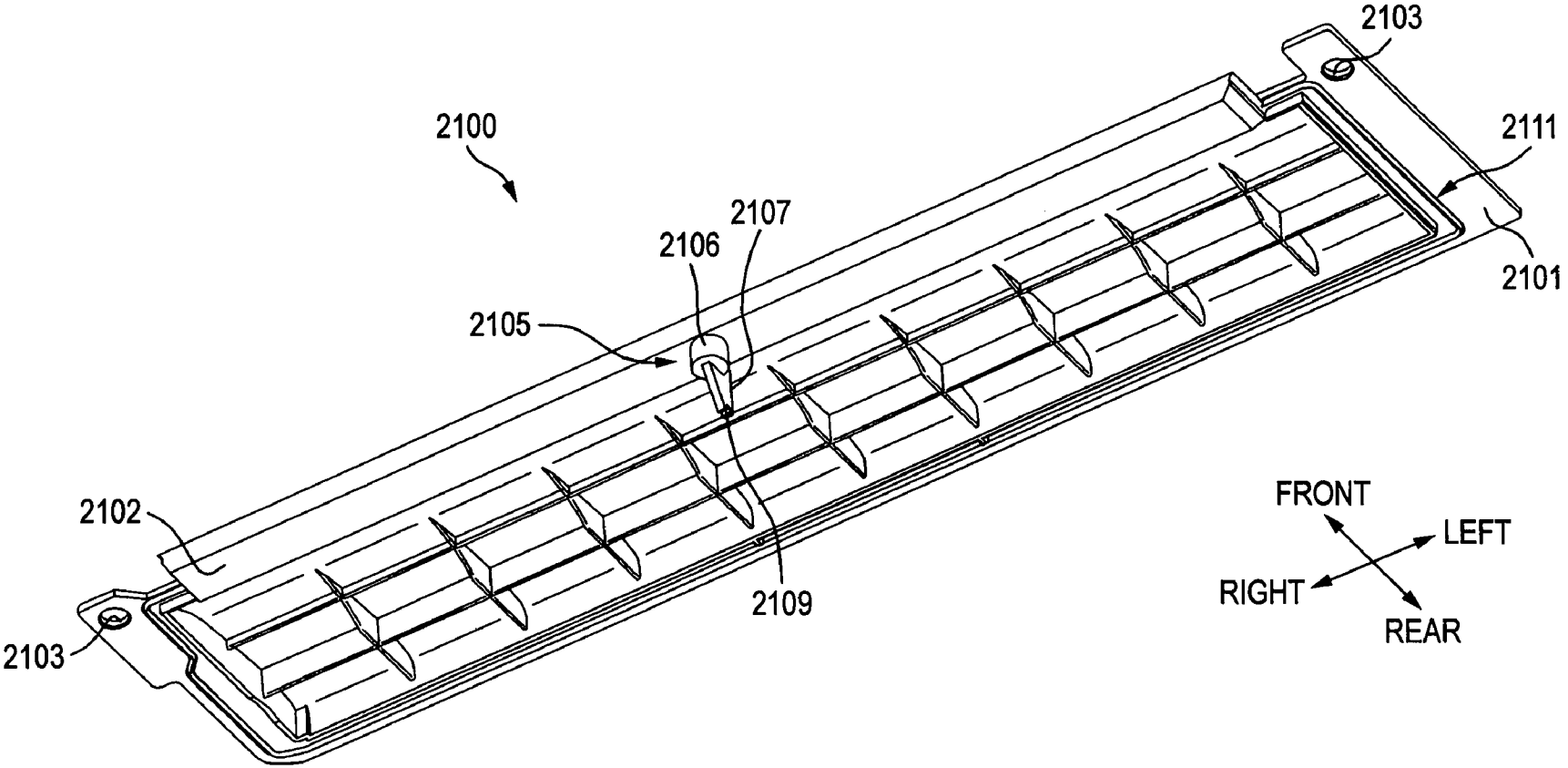
FIG. 18 is a perspective view of an upper frame when viewed from below.
Figure 19:
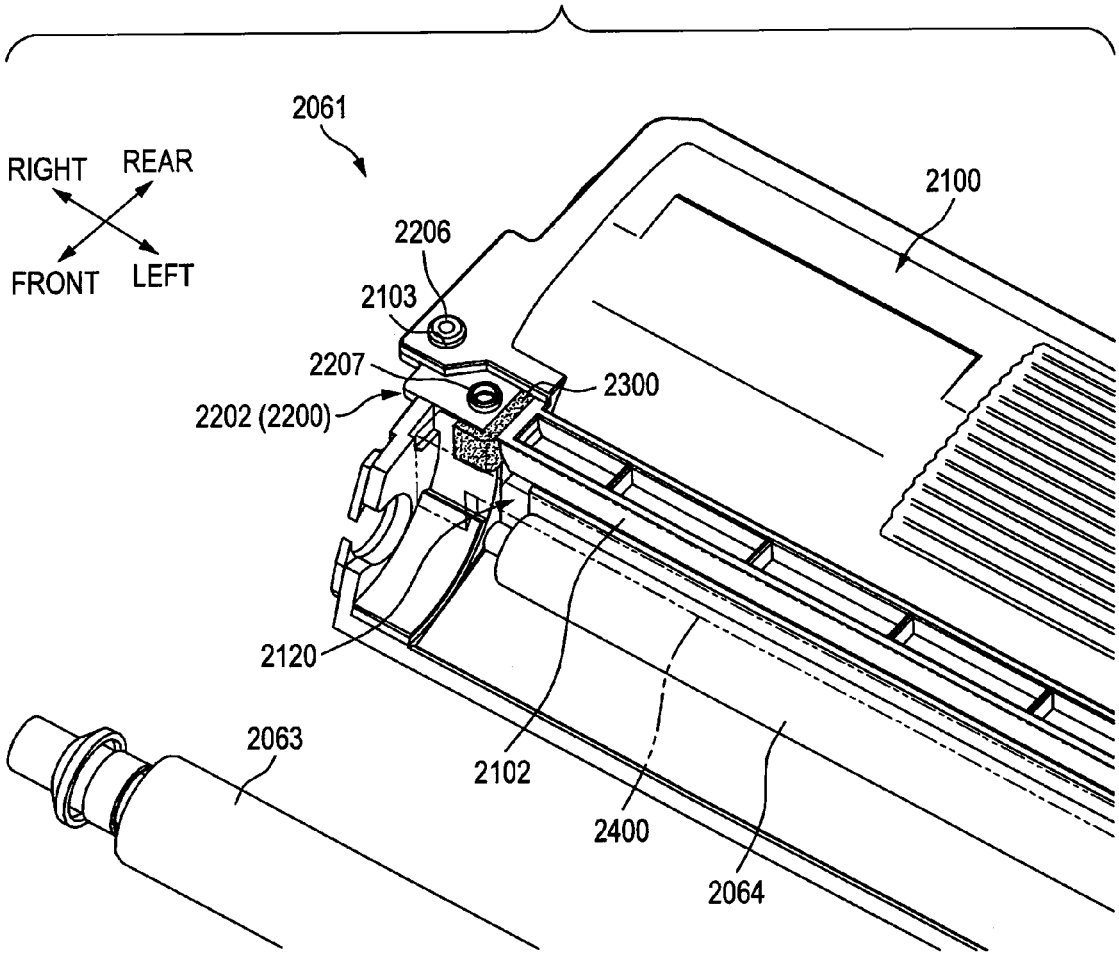
FIG. 19 is a partial perspective view showing a frame seal and a blade rear seal member attached to a developing case.
Figure 20:
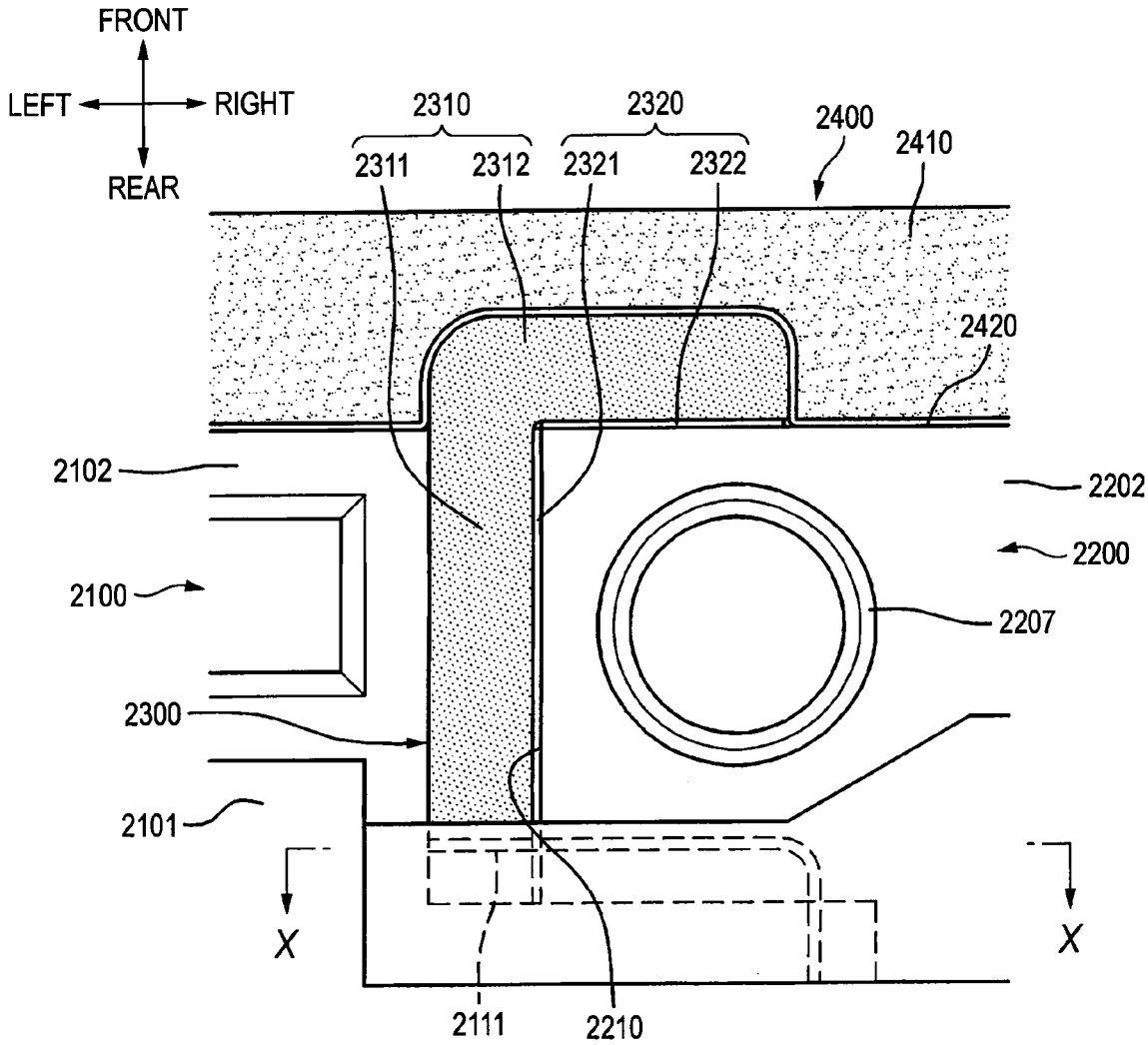
FIG. 20 is a diagram of a frame seal and a blade rear seal member when viewed from above.
Figure 21:
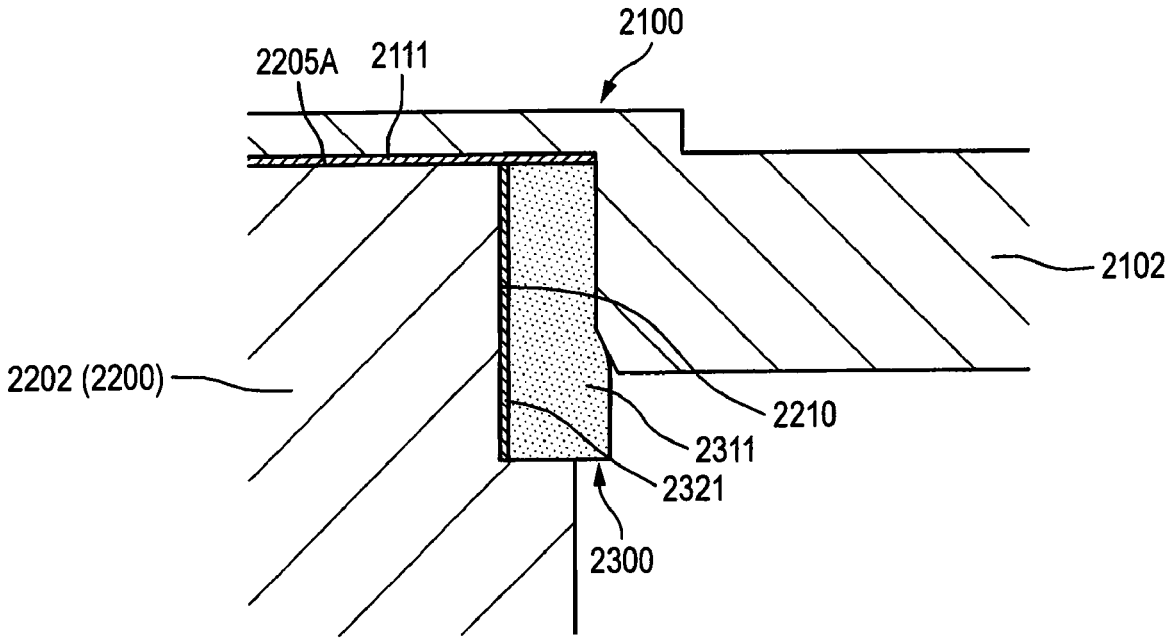
FIG. 21 is a sectional view taken along the line X-X of FIG. 20.
Figure 22:
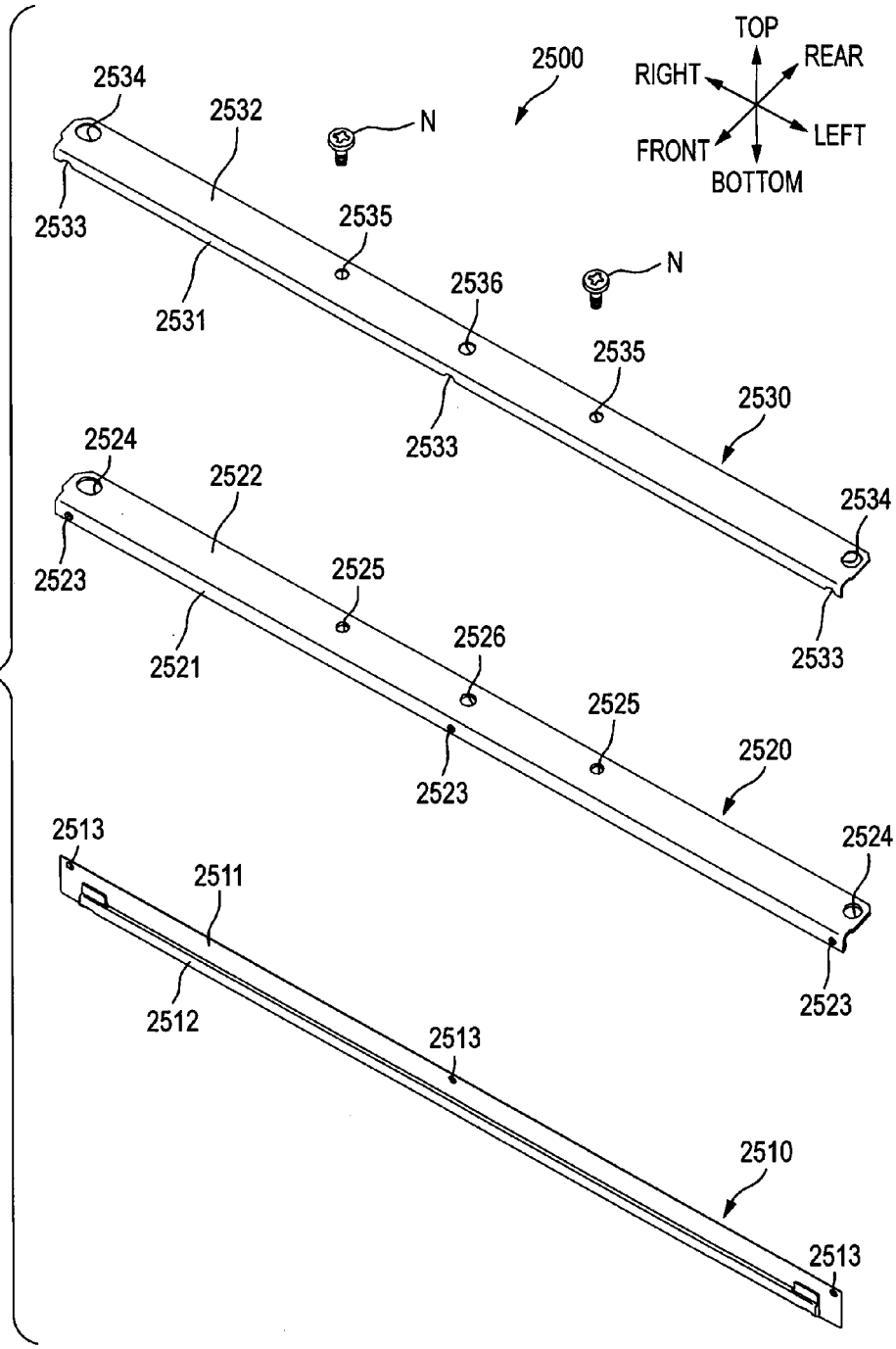
FIG. 22 is an exploded perspective view of a layer thickness regulating blade.
Figure 23:
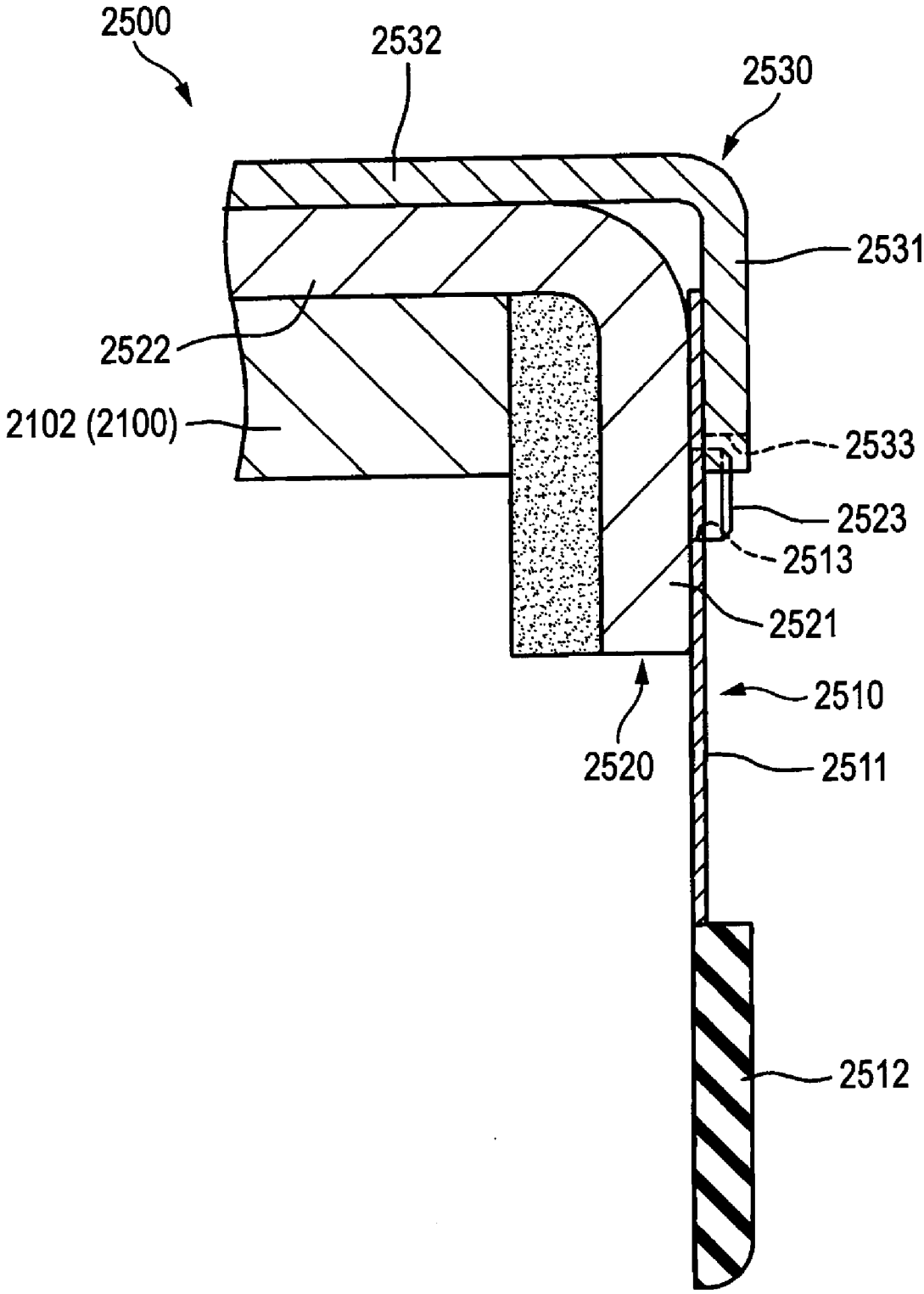
FIG. 23 is a sectional view of a layer thickness regulating blade fixed to a developing case.

Next, the detailed configuration of the developing cartridge 2061 will be described. FIG. 15 is a perspective view of a developing cartridge. FIG. 16 is an exploded perspective view of a developing cartridge. FIG. 17 is a perspective view of a lower frame. FIG. 18 is a perspective view of an upper frame when viewed from below. FIG. 19 is a partial perspective view showing a frame seal and a blade rear seal member attached to a developing case. FIG. 20 is a diagram of a frame seal and a blade rear seal member when viewed from above. FIG. 21 is a sectional view taken along the line X-X of FIG. 20. FIG. 22 is an exploded perspective view of a layer thickness regulating blade. FIG. 23 is a sectional view of a layer thickness regulating blade fixed to a developing case.

In the following descriptions, directions are defined as the developing cartridge 2061 is transversely situated, as shown in FIG. 15. That is, in FIG. 15, with respect to the developing case 2062, the side on which the layer thickness regulating blade 2500 is attached is referred to as the "up" side, the opposite side is referred to as the "down" side, the side on which the developing roller 2063 is disposed is referred to as the "front" side, and the opposite side is referred to as the "rear" side. The left-right direction based on the up, down, left, and right directions defined as above is referred to as the "left-right" direction.

As shown in FIGS. 15 and 16, the developing cartridge 2061 includes a lower frame 2200 and an upper frame 2100 which are an example of a first frame and a second frame and constitute the developing case 2062, a frame seal 2300 (see FIG. 19), a blade rear seal member 2400 (see FIG. 19), and a layer thickness regulating blade 2500.

[Configuration of Lower Frame]

As shown in FIG. 17, the lower frame 2200 has a left side wall 2201 and a right side wall 2202 as an example of a pair of side walls, a bottom wall 2203 as an example of a connection wall, and a rear side wall 2204.

The left side wall 2201 and the right side wall 2202 are opposite each other in the left-right direction, and the lower ends thereof are connected by the bottom wall 2203. The rear ends of the left side wall 2201, the right side wall 2202, and the bottom wall 2203 are connected by the rear side wall 2204. The left side wall 2201, the right side wall 2202, and the rear side wall 2204 have an upper surface 2205 as the same plane.

Specifically, the upper surface 2205 has first upper surface portions 2205A which protrude inward from the inner surfaces of the left side wall 2201 and the right side wall 2202, second upper surface portions 2205B which are the upper surfaces of the left side wall 2201 and the right side wall 2202, and a third upper surface portion 2205C which is the upper surface of the rear side wall 2204.

The front sides of the first upper surface portions 2205A are used as a fixing portion to which the layer thickness regulating blade 2500 is fixed, and the rear ends of the first upper surface portions 2205A, the second upper surface portions 2205B, and the third upper surface portion 2205C are used as a welding portion to which the upper frame 2100 is welded. That is, in this embodiment, the fixing portion to which the layer thickness regulating blade 2500 is fixed, and the welding portion to which the upper frame 2100 is welded are provided on the same surface.

On the front side of each second upper surface portion 2205B, a boss 2206 which is an example of a convex portion for positioning the upper frame 2100 with respect to the lower frame 2200 is formed. At each first upper surface portion 2205A, a cylindrical closed-end attachment boss 2207 for attaching the layer thickness regulating blade 2500 is formed.

At the inner upper portion of the protruding portion of each of the left side wall 2201 and the right side wall 2202 constituting the first upper surface portion 2205A, a seal attachment portion 2210 is cut out downward. The frame seal 2300 described below is attached to the seal attachment portion 2210.

At the bottom wall 2203, a partition wall 2208 is formed at the substantially center in the front-rear direction so as to protrude forward, such that a space sandwiched with the lower frame 2200 and the upper frame 2100 is partitioned into an opening 2120 (see FIG. 19) side and an opposite side to the opening 2120. At the substantially center of the front end of the partition wall 2208, an engagement groove 2209 with which a support portion 2105 of the upper frame 2100 described below is engaged is formed.

The supply roller 2064 is provided on the front side of the partition wall 2208 so as to be adjacent to the partition wall 2064, and the developing roller 2063 is provided upward on the front side of the supply roller 2064 so as to be adjacent to the supply roller 2064. Thus, the developing roller 2063 is exposed to the outside through the opening 2120 (see FIG. 19).

[Configuration of Upper Frame]

As shown in FIG. 16, the upper frame 2100 has a plate-shaped main body portion 2101, and a beam-like portion 2102 which protrudes downward from the front end of the main body portion 2101. The upper frame 2100 is combined with the lower frame 2200, such that the opening 2120 (see FIG. 19) is formed by the left side wall 2201, the right side wall 2202, and the bottom wall 2203 of the lower frame 2200, and the beam-like portion 2102 of the upper frame 2100.

At the left and right ends on the front side of the main body portion 2101, boss holes 2103 are formed which are an example of a concave portion and are engaged with the bosses 2206 of the lower frame 2200 so as to position the upper frame 2100 with respect to the lower frame 2200. An escape portion 2104 which is depressed rearward to escape from each attachment boss 2207 of the lower frame 2200 is formed between a portion of the main body portion 2101 where each boss hole 2103 is formed and the beam-like portion 2102.

As shown in FIG. 18, at the substantially center of the lower surface of the beam-like portion 2102, a support portion 2105 is formed so as to protrude toward the lower frame 2200 (downward). The support portion 2105 has a columnar base portion 2106, and an engagement piece portion 2107 which protrudes downward from the lower end of the base portion 2106.

The base portion 2106 is positioned at the lower surface of a screw attachment hole 2108 (see FIG. 16) which is formed at the upper surface of the beam-like portion 2102.

The engagement piece portion 2107 is formed to have a substantially triangular shape in side view. At the front end of the engagement piece portion 2107, an engagement groove 2109 is formed so as to be engaged with the engagement groove 2209 of the partition wall 2208 of the lower frame 2200 (see FIG. 19). The upper frame 2100 and the lower frame 2200 are combined with each other, and the engagement groove 2109 of the engagement piece portion 2107 is engaged with the engagement groove 2209 of the partition wall 2208. Thus, the beam-like portion 2102 of the upper frame 2100 is supported by the bottom wall 2203 through the support portion 2105 and the partition wall 2208.

Around the lower surface of the main body portion 2101, a welding rib 2111 is formed as an example of a welding portion which is welded to the upper surface 2205 (see FIG. 17) of the left side wall 2201, the right side wall 2202, and the rear side wall 2204 of the lower frame 2200.

[Configuration of Frame Seal and Blade Rear Seal Member]

As shown in FIG. 19, the frame seal 2300 is disposed between the left side wall 2201 and the left end surface of the beam-like portion 2102 and between the right side wall 2202 and the right end surface of the beam-like portion 2102 (in FIG. 19, only the portion on the right side wall 2202 side is shown) in a state where the lower frame 2200 and the upper frame 2100 are assembled with each other. The blade rear seal member 2400 is attached over the front surfaces of the left side wall 2201 and the right side wall 2202 of the lower frame 2200, and the front surface of the beam-like portion 2102 of the upper frame 2100. The front surfaces of the left side wall 2201 and the right side wall 2202, and the front surface of the beam-like portion 2102 form the substantially same surface when the lower frame 2200 and the upper frame 2100 are assembled with each other.

Hereinafter, only the configuration on the right side wall 2202 side will be described in detail, and the configuration on the left side wall 2201 side having the same configuration will be omitted.

As shown in FIG. 20, the frame seal 2300 mainly includes an elastic layer 2310 which is formed of a soft material, such as sponge or the like, and a double-sided tape layer 2320 as an example of an adhesive base material which is provided on the surface of the elastic layer 2310 facing the lower frame 2200.

The elastic layer 2310 has a first elastic portion 2311 which is sandwiched with the right side wall 2202 of the lower frame 2200 and the beam-like portion 2102 of the upper frame 2100, and a second elastic portion 2312 which is formed by bending the end portion facing the blade rear seal member 2400 outward (rightward). A first double-sided tape layer 2321 is provided on the surface of the first elastic portion 2311 in contact with the lower frame 2200, and a second double-sided tape layer 2322 is provided on the surface of the second elastic portion 2312 in contact with the lower frame 2200.

In this embodiment, in a state where the front end of the sheet-like frame seal 2300 having a substantially rectangular shape in plan view protrudes forward from the front surface of the right side wall 2202, the rear end of the frame seal 2300 is attached to the seal attachment portion 2210 of the right side wall 2202 by the first double-sided tape layer 2321. Next, the front end of the frame seal 2300 is bent outward and then attached to a portion of the front surface of the right side wall 2202 by the second double-sided tape layer 2322. Thus, the first elastic portion 2311 and the second elastic portion 2312 are formed.

After the frame seal 2300 is attached to the lower frame 2200, the upper frame 2100 is assembled with the lower frame 2200. At this time, the frame seal 2300 is slightly compressed by the lower frame 2200 and the upper frame 2100, so the first elastic portion 2311 is elastically deformed so as to block the gap between the right side wall 2202 and the beam-like portion 2102. As shown in FIGS. 20 and 21, if the upper frame 2100 is assembled with the lower frame 2200, a portion of the welding rib 2111 provided in the upper frame 2100 on the opening 2120 side (front side) is welded together with the upper surface of the rear end of the frame seal 2300 (first elastic portion 2311).

As shown in FIGS. 19 and 20, the blade rear seal member 2400 is formed to have a U shape in plan view. The blade rear seal member 2400 includes an elastic layer 2410 which is formed of a soft material, such as sponge or the like, and a double-sided tape layer 2420 as an example of an adhesive base material which is provided on the surface facing the lower frame 2200 and the upper frame 2100.

The blade rear seal member 2400 is attached to the right side wall 2202, the beam-like portion 2102, and the left side wall 2201 after the upper frame 2100 is assembled with the lower frame 2200 to which the frame seal 2300 is attached. Thus, the second elastic portion 2312 of the frame seal 2300 and the blade rear seal member 2400 come into contact with each other. If the layer thickness regulating blade 2500 is fixed so as to be pressed against the blade rear seal member 2400, the second elastic portion 2312 and the elastic layer 2410 of the blade rear seal member 2400 are elastically deformed. Thus, the frame seal 2300 (second elastic portion 2312) and the blade rear seal member 2400 come into close contact with each other.

[Configuration of Layer Thickness Regulating Blade]

As shown in FIGS. 16 and 22, the layer thickness regulating blade 2500 includes a blade plate metal 2510, a blade holder 2520, and a blade reinforcing plate 2530.

The blade plate metal 2510 has a plate-shaped member 2511 which is a rectangular thin metal plate, and a rubber-like pressing member 2512 which is provided so as to be swollen to the developing roller 2063 side (front side) at the lower end of the plate-shaped member 2511, and directly comes into slide contact with the developing roller 2063. At the upper end of the plate-shaped member 2511, three positioning openings 2513 into which protrusions 2523 of the blade holder 2520 described below are inserted are formed at both ends and the center in the left-right direction in total.

The blade holder 2520 is formed by bending a metal plate at a substantially right angle, and has a sandwiching portion 2521 as an example of a first plate-shaped portion which extends in the up-down direction, and an attachment portion 2522 as an example of a second plate-shaped portion which is bent and extends from the sandwiching portion 2521 at a substantially right angle.

The sandwiching portion 2521 sandwiches the blade plate metal 2510 together with a sandwiching portion 2531 of the blade reinforcing plate 2530 described below. At the front surface of the sandwiching portion 2521, three protrusions 2523 which are inserted into the positioning openings 2513 of the blade plate metal 2510 are formed at both ends and the center in the left-right direction in total.

The attachment portion 2522 is configured such that both ends thereof are fixed to the lower frame 2200. The attachment portion 2522 is formed to have a planar shape along the upper surface 2205 (first upper surface portion 2205A) of the lower frame 2200 and the beam-like portion 2102 of the upper frame 2100.

At both ends of the attachment portion 2522, attachment holes 2524 for screwing the attachment portion 2522 with respect to the lower frame 2200 are formed. A pair of screw attachment holes 2525 are formed between a pair of attachment holes 2524 so as to fix the blade holder 2520 and the blade reinforcing plate 2530 to each other. An insertion hole 2526 which corresponds to the screw attachment hole 2108 formed in the beam-like portion 2102 of the upper frame 2100 is formed between a pair of screw attachment holes 2525 (at the substantially center of the attachment portion 2522).

The blade reinforcing plate 2530 is formed by bending a metal plate at a substantially right angle. The blade reinforcing plate 2530 includes a sandwiching portion 2531 which extends in the up-down direction, and an attachment portion 2532 which is bent and extends from the sandwiching portion 2521 at a substantially right angle.

The sandwiching portion 2531 sandwiches the blade plate metal 2510 together with the sandwiching portion 2521 of the blade holder 2520. At the front surface of the sandwiching portion 2531, three substantially semicircular cutout portions 2533 which keep off from the protrusions 2523 provided in the blade holder 2520 are formed at both ends and the center in the left-right direction in total.

The attachment portion 2532 is provided with a pair of attachment holes 2534, a pair of screw attachment holes 2535, and an insertion hole 2536 which are formed to correspond to a pair of attachment holes 2524, a pair of screw attachment holes 2525, and the insertion hole 2526 of the blade holder 2520.

The layer thickness regulating blade 2500 configured as above is assembled by screwing screws N into the screw attachment holes 2525 and 2535 from the blade reinforcing plate 2530 side in a state where the blade plate metal 2510 is sandwiched between the sandwiching portion 2521 of the blade holder 2520 and the sandwiching portion 2531 of the blade reinforcing plate 2530.

As shown in FIGS. 16 and 15, the attachment holes 2524 and 2534 are fitted to the attachment bosses 2207 formed the first upper surfaces 2205A of the left side wall 2201 and the right side wall 2202 of the lower frame 2200, and both ends of the attachment portions 2522 and 2532 are fixed to the attachment bosses 2207 by screws (not shown), thus the layer thickness regulating blade 2500 is fixed to the lower frame 2200. A screw (not shown) is inserted from the insertion holes 2526 and 2536 and screwed into the screw attachment hole 2108 formed in the beam-like portion 2102 of the upper frame 2100. Thus, the layer thickness regulating blade 2500 and the beam-like portion 2102 (upper frame 2100) are fixed.

In a state where the layer thickness regulating blade 2500 is fixed over the left side wall 2201 and right side wall 2202 of the lower frame 2200, and the beam-like portion 2102 of the upper frame 2100, as shown in FIG. 23, the beam-like portion 2102 of the upper frame 2100 is positioned below the attachment portions 2522 and 2532. At this time, the blade rear seal member 2400 is sandwiched between the layer thickness regulating blade 2500 (sandwiching portion 2521) and the beam-like portion 2102 while being slightly compressed. Therefore, the blade rear seal member 2400 is elastically deformed so as to block the gap between the layer thickness regulating blade 2500 and the beam-like portion 2102.

<Method of Assembling Developing Cartridge>

Next, a method of assembling the developing cartridge 2061 configured as above will be described.

A portion serving as the first elastic portion 2311 of the sheet-like frame seal 2300 is attached to the seal attachment portions 2210 of the left side wall 2201 and the right side wall 2202 of the lower frame 2200, and a portion serving as the second elastic portion 2312 is bent and attached to the front surfaces of the left side wall 2201 and the right side wall 2202 (see FIG. 19).

Next, the boss holes 2103 of the upper frame 2100 are fitted to the bosses 2206 of the lower frame 2200, and the upper frame 2100 is assembled with the lower frame 2200 in a state where the upper frame 2100 is positioned with respect to the lower frame 2200. At this time, the front end (engagement groove 2109) of the support portion 2105 formed in the beam-like portion 2102 of the upper frame 2100 is engaged with the engagement groove 2209 of the partition wall 2208 formed at the bottom wall 2203 of the lower frame 2200. Thus, the beam-like portion 2102 is supported by the bottom wall 2203 (see FIG. 16).

Next, the welding rib 2111 of the upper frame 2100 is welded so as to fix the upper frame 2100 to the lower frame 2200. At this time, a portion on the front side of the welding rib 2111 is welded together with the rear end of the frame seal 2300. After welding, the supply roller 2064 is attached to the lower frame 2200, the existing members are appropriately provided at the positions of the lower frame 2200 corresponding to both ends and the lower portion of the developing roller 2063. Thereafter, the developing roller 2063 is attached to the lower frame 2200 (see FIG. 19).

Next, the blade rear seal member 2400 is attached over the entire front surfaces of the left side wall 2201, the beam-like portion 2102, and the right side wall 2202, then the attachment holes 2524 and 2534 of the layer thickness regulating blade 2500 are fitted to the attachment bosses 2207 of the lower frame 2200, and subsequently both ends of the layer thickness regulating blade 2500 are fixed to the attachment bosses 2207 by screws. Finally, a screw is inserted into the screw attachment hole 2108 of the upper frame 2100 from the insertion holes 2526 and 2536 of the layer thickness regulating blade 2500 so as to fix the beam-like portion 2102 to the layer thickness regulating blade 2500. Thus, the developing cartridge 2061 is assembled (see FIGS. 15 and 16).

According to the above-described configuration, this embodiment can obtain the following advantages. One end of the frame seal 2300 is bent, and the elastic layer 2310 (second elastic portion 2312) comes into close contact with the blade rear seal member 2400, so the occurrence of a gap can be suppressed. Further, the second double-sided tape layer 2322 is provided on the side of the bent portion (second elastic portion 2312) facing the lower frame 2200, that is, on the opposite side to the blade rear seal member 2400 with the second elastic portion 2312 interposed therebetween. For this reason, the second elastic portion 2312 and the blade rear seal member 2400 can reliably come into close contact with each other, and thus the occurrence of a gap can be suppressed. Therefore, the occurrence of a gap between the frame seal 2300 and the blade rear seal member 2400 can be suppressed. As a result, toner leakage can be suppressed.

The support portion 2105 is provided between the beam-like portion 2102 and the bottom wall 2203 such that the beam-like portion 2102 is supported by the bottom wall 2203, so rigidity on the front side of the upper frame 2100 can be increased. Further, the support portion 2105 which protrudes downward from the beam-like portion 2102 is engaged with the front end (engagement groove 2209) of the partition wall 2208 which protrudes upward from the bottom wall 2203. Therefore, the support portion 2105 can be shortened, and rigidity of the support portion 2105 itself can be increased. With the increased rigidity, the deformation of the upper frame 2100 is suppressed, so the occurrence of a gap between the upper frame 2100 and each member in contact with the upper frame 2100 is suppressed. As a result, toner leakage can be reliably suppressed.

The layer thickness regulating blade 2500 includes the attachment portion 2522 which is bent from the sandwiching portion 2521 along the upper surface of the upper frame 2100, so with the attachment portion 2522 (and the attachment portion 2532), the beam-like portion 2102 can be protected from a force applied to the beam-like portion 2102. Therefore, the deformation of the upper frame 2100 is suppressed, so the occurrence of a gap is suppressed. As a result, toner leakage can be more reliably suppressed.

The layer thickness regulating blade 2500 is configured such that both ends thereof are fixed to the left side wall 2201 and the right side wall 2202, so the left side wall 2201 and the right side wall 2202 are connected to each other by the layer thickness regulating blade 2500, which can increase rigidity of the lower frame 2200. Therefore, the deformation of the lower frame 2200 is suppressed, so the occurrence of a gap between the lower frame 2200 and each member in contact with the lower frame 2200 is suppressed. As a result, toner leakage can be more reliably suppressed.

The layer thickness regulating blade 2500 is configured such that both ends of the attachment portions 2522 and 2532 bent from the sandwiching portions 2521 and 2531 are fixed to the left side wall 2201 and the right side wall 2202. With this configuration, the length of the layer thickness regulating blade 2500 in the up-down direction can be shortened, as compared with the configuration in which the layer thickness regulating blade 2500 is fixed to the lower frame 2200 on the same surface as the blade plate metal 2510 (sandwiching portions 2521 and 2531). Therefore, the lower frame 2200 can be reduced in size in the up-down direction, so rigidity of the lower frame 2200 can be increased and the deformation of the lower frame 2200 can be suppressed. As a result, toner leakage can be more reliably suppressed.

The blade rear seal member 2400 is provided over the left side wall 2201, the right side wall 2202, and the beam-like portion 2102, so the blade rear seal member 2400 can block the gap between the lower frame 2200 and the upper frame 2100, together with the frame seal 2300. As a result, toner leakage from the relevant portion can be more reliably suppressed.

The bosses 2206 formed at the upper surface 2205 (first upper surface portion 2205A) of the lower frame 2200 are engaged with the boss holes 2103 formed at the left and right ends on the front side of the upper frame 2100, such that the lower frame 2200 and the upper frame 2100 are positioned. Therefore, misalignment during welding can be suppressed, and thus, the occurrence of a gap between the lower frame 2200 and the upper frame 2100 is suppressed. As a result, toner leakage can be more reliably suppressed.

A portion on the front side of the welding rib 2111 is welded together with the upper surface of the rear end of the frame seal 2300. Therefore, toner leakage from the gap between the left side wall 2201 and the right side wall 2202 of the lower frame 2200, and the upper frame 2100 can be more reliably suppressed.

The beam-like portion 2102 is fixed to the layer thickness regulating blade 2500, so rigidity on the front side of the upper frame 2100 can be increased. Therefore, the deformation of the upper frame 2100 is suppressed, so the occurrence of a gap is suppressed. As a result, toner leakage can be more reliably suppressed.

The fixing portion to which the attachment portions 2522 and 2532 of the layer thickness regulating blade 2500 are fixed, and the welding portion to which the upper frame 2100 is welded are provided on the same surface (upper surface 2205), so the structure can be simplified, as compared with the configuration in which the fixing portion and the welding portion are provided on different surfaces (a step is formed). Therefore, the shape of the gap between the lower frame 2200 and the upper frame 2100 can be simplified, so the gap can be easily blocked. As a result, toner leakage can be more reliably suppressed.

Although the embodiment of the invention has been described, the invention is not limited to the foregoing embodiments. With regard to specific configuration, various modifications may be made without departing from the spirit of the invention.

Although in the above-described embodiment, an example where the sheet-like frame seal 2300 is attached to the lower frame 2200 so as to form the bent portion (second elastic portion 2312) has been described, the invention is not limited thereto. For example, a frame seal which is formed in advance to have a substantially L shape in plan view may be used. Although in the foregoing embodiments, an example where the front end of the frame seal 2300 is bent outward so as to form the second elastic portion 2312 has been described, the invention is not limited thereto. For example, the front end of the frame seal 2300 may be bent inward (toward the beam-like portion 2102) so as to form the second elastic portion 2312.

Figure 24:
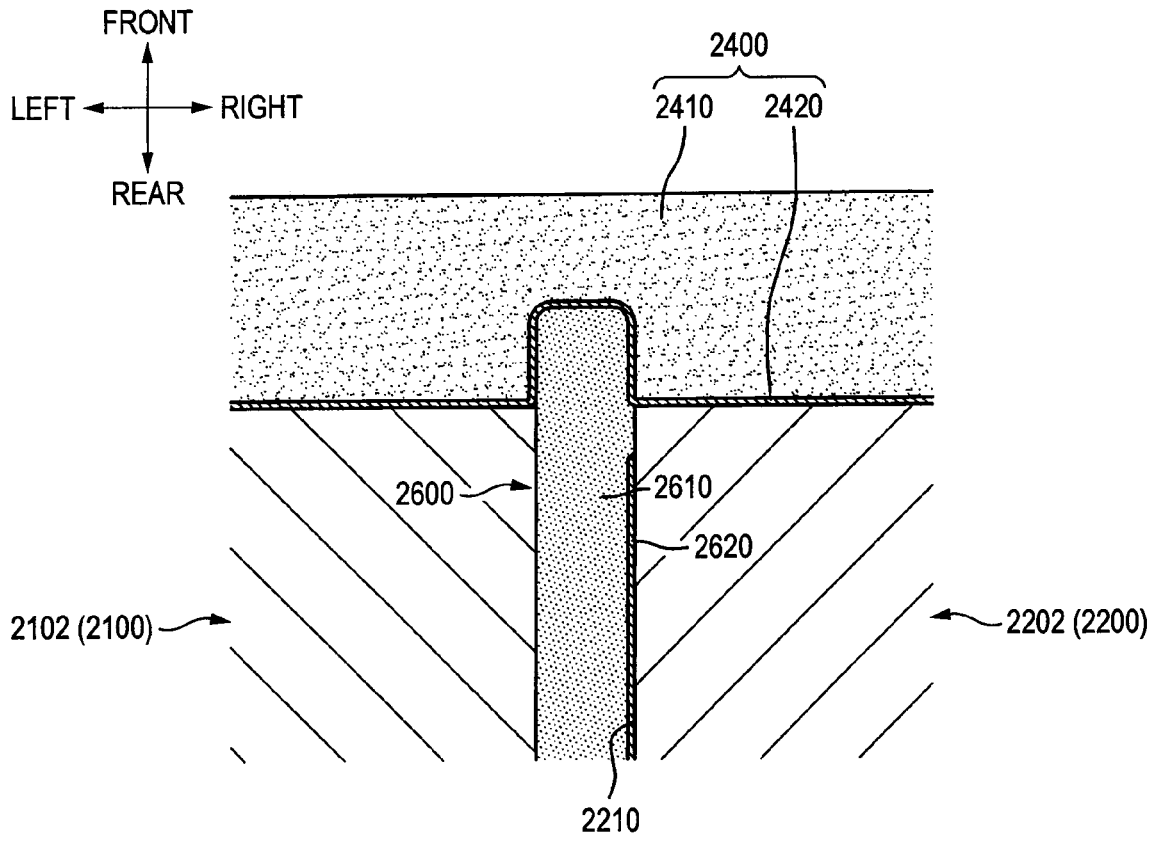
FIG. 24 is a diagram of a frame seal and a blade rear seal member according to a modification when viewed from above.

Although in the above-described embodiment, the frame seal 2300 having the bent portion (second elastic portion 2312) is used as a frame seal, the invention is not limited thereto. For example, as shown in FIG. 24, a frame seal 2600 is a sheet-like member having a substantially rectangular shape in plan view, and includes an elastic layer 2610, a double-sided tape layer 2620 which is provided on the surface of the elastic layer 2610 facing the right side wall 2202 of the lower frame 2200.

The front end of the elastic layer 2610 protrudes forward from the double-sided tape layer 2620, specifically, from the front surface of the right side wall 2202, and bites into the blade rear seal member 2400 attached to the lower frame 2200 and the upper frame 2100. The double-sided tape layer 2620 is configured such that the length thereof in the front-rear direction is shorter than the elastic layer 2610. Specifically, the double-sided tape layer 2620 is provided to have such a length that the front end thereof does not reach the blade rear seal member 2400.

With this configuration, the elastic layer 2610 protrudes forward from the double-sided tape layer 2620, and only the elastic layer 2610 bites into the blade rear seal member 2400, so the elastic layer 2610 and the blade rear seal member 2400 can come into close contact with each other so as to suppress the occurrence of a gap. Further, the double-sided tape layer 2620 does not bite into the blade rear seal member 2400, so the occurrence of a gap due to pressure of the double-sided tape layer 2620 against the blade rear seal member 2400 can be suppressed. Therefore, the occurrence of the gap between the frame seal 2600 and the blade rear seal member 2400 can be suppressed. As a result, toner leakage can be suppressed.

The gap between the double-sided tape layer 2620 and the blade rear seal member 2400 is filled and blocked by the elastic layer 2610, so toner leakage from the relevant portion is suppressed. Although in FIG. 24, an example where the double-sided tape layer 2620 is provided to have such a length that the front end thereof does not reach the blade rear seal member 2400 has been described, the invention is not limited thereto. For example, the double-sided tape layer 2620 may be provided to have such a length that the front end thereof comes into light contact with the blade rear seal member 2400.

Figure 25A:
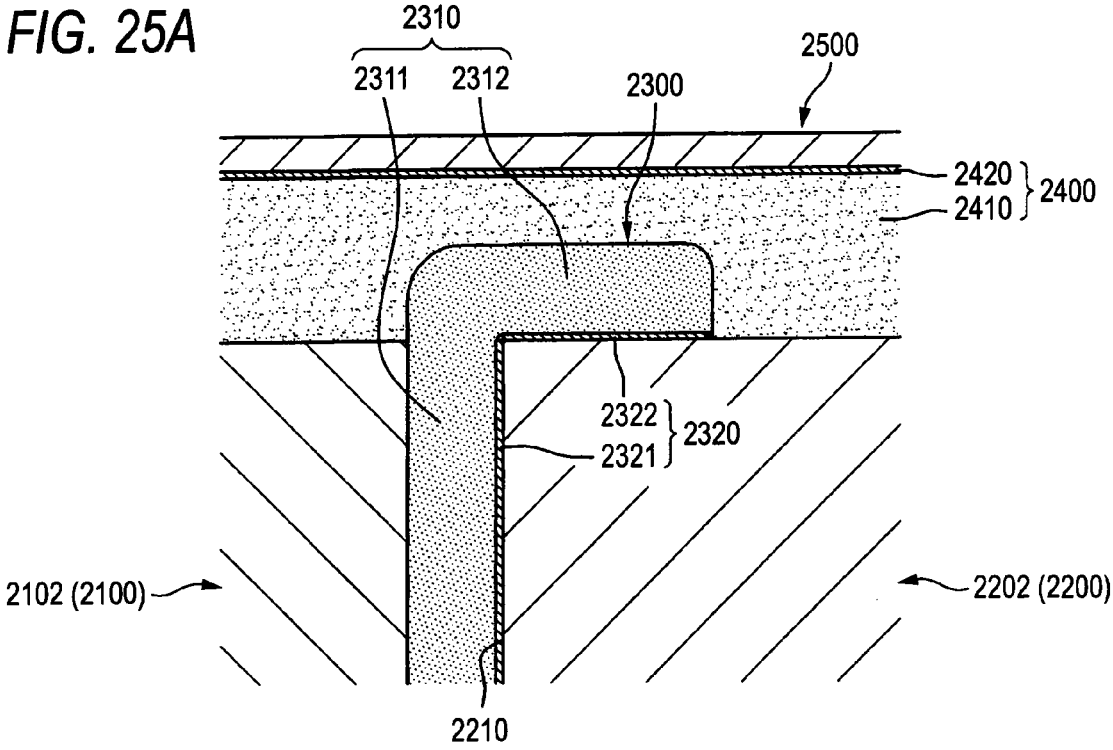
FIGS. 25A and 25B are diagram showing the configuration of a modification in which a double-sided tape of a blade rear seal member is provided on a layer thickness regulating blade side.
Figure 25B:
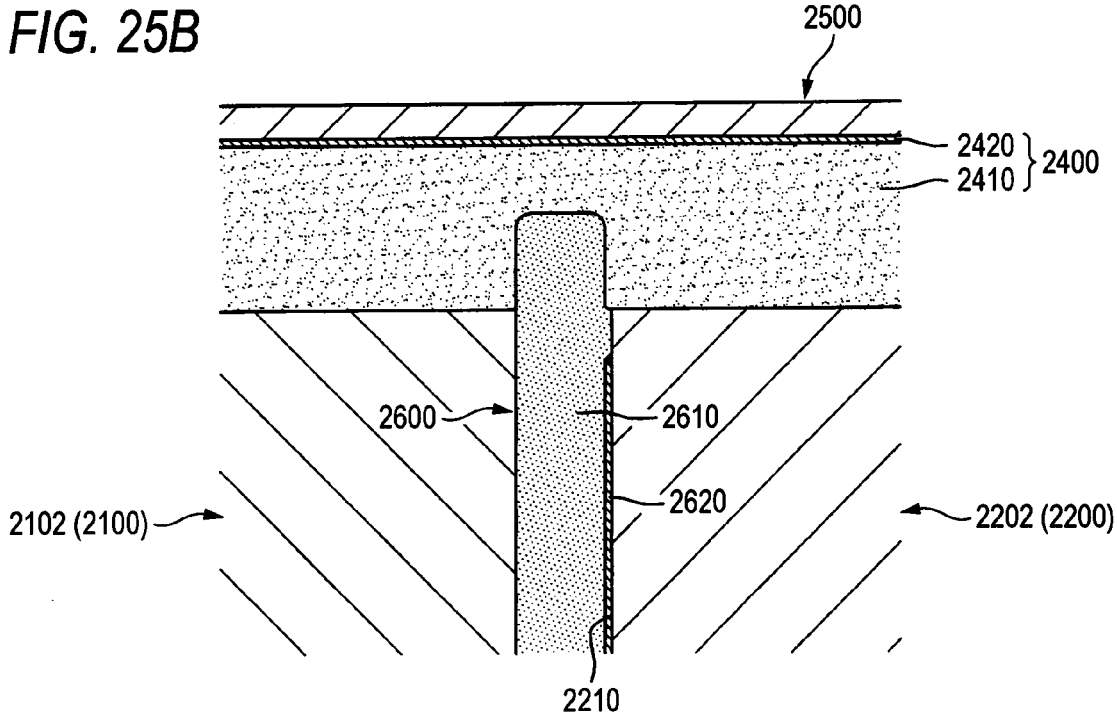

Although in the above-described embodiment, an example where the double-sided tape layer 2420 (adhesive base material) is provided on the surface of the blade rear seal member 2400 facing the lower frame 2200 and the upper frame 2100 has been described, the invention is not limited thereto. For example, as shown in FIGS. 25A and 25B, the double-sided tape layer 2420 may be provided on the surface of the blade rear seal member 2400 in contact with the layer thickness regulating blade 2500. In this case, the blade rear seal member 2400 is attached in advance to the layer thickness regulating blade 2500, and is then attached to the lower frame 2200 and the upper frame 2100, together with the layer thickness regulating blade 2500.

With this configuration, the elastic layer 2310 or 2610 of the frame seal 2300 or 2600 comes into direct contact with the elastic layer 2410 of the blade rear seal member 2400, so the frame seal 2300 or 2600 and the blade rear seal member 2400 can further come into close contact with each other. Therefore, toner leakage can be more reliably suppressed.

Although in the above-described embodiment, the double-sided tape layers 2320, 2420, and 2620 have been illustrated as an example of an adhesive base material, the invention is not limited thereto. For example, an adhesive which is hardened more than the material of the elastic layer after hardening may be used.

Although in the foregoing embodiment, the configuration in which the support portion 2105 which protrudes from the beam-like portion 2102 is engaged with the front end of the partition wall 2208 which protrudes from the bottom wall 2203 has been described, the invention is not limited thereto. For example, the beam-like portion 2102 may be supported by a support portion which protrudes upward from the front end of the partition wall 2208, or the support portion which protrudes from the beam-like portion 2102 may come into direct contact with the bottom wall 2203. A plurality of support portions may be formed.

Although in the foregoing embodiment, the bosses 2206 (convex portion) are formed in the lower frame 2200, and the boss holes 2103 (concave portion) are formed in the upper frame 2100, the invention is not limited thereto. For example, a concave portion may be formed in the lower frame 2200, and a convex portion may be formed in the upper frame 2100.

Although in the foregoing embodiment, the developing device (developing cartridge 2061) of the invention is used in the color printer 2001, the invention is not limited thereto. For example, the developing device of the invention may be used in a copy machine, a multi function device, a monochrome printer, or the like.

The arrangement of the lower frame 2200 and the upper frame 2100 may be inverted vertically with respect to the foregoing embodiments.

What is claimed is:

1. A developing device comprising:

a developing unit housing;

a developer carrier that configured to carry developer; the developer carrier being rotatably supported by the developing unit housing;

a side seal member that comes into slidable contact with both ends of the developer carrier;

a sheet-like elongated seal member that extends in an axial direction of the developer carrier so as to come into slidable contact with the developer carrier;

a side seal attachment surface that is formed in the developing unit housing and to which the side seal member is attached; and a support portion that is formed in the developing unit housing and protrudes toward the developer carrier from the side seal attachment surface to support the elongated seal member, wherein the elongated seal member is attached onto the support portion in a state where both ends thereof overlap the side seal member and are opposite the side seal attachment surface, a filler is filled in a gap surrounded by the elongated seal member, the side seal member, the support portion, and the side seal attachment surface, and a protrusion for suppressing a spread of the filler is formed at the side seal attachment surface at a predetermined interval from the support portion.

2. The developing device according to claim 1, wherein the side seal member comes into contact with the protrusion and is positioned.

3. The developing device according to claim 1, wherein an opposing surface of the protrusion with respect to the support portion is inclined so as to be close to the support portion with a decreasing distance toward the side seal member.

* * * * *